US008364056B2

(12) United States Patent
Miyahara

(10) Patent No.: US 8,364,056 B2
(45) Date of Patent: Jan. 29, 2013

(54) IMAGE FORMING DEVICE HAVING CLEANING MEMBER FOR CLEANING BELT

(75) Inventor: Kensuke Miyahara, Hekinan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 155 days.

(21) Appl. No.: 13/034,335

(22) Filed: Feb. 24, 2011

(65) Prior Publication Data

US 2011/0222902 A1 Sep. 15, 2011

(30) Foreign Application Priority Data

Mar. 9, 2010 (JP) ..... 2010-051606

(51) Int. Cl.
*G03G 15/16* (2006.01)
*G03G 21/18* (2006.01)

(52) U.S. Cl. ..... 399/101; 399/112

(58) Field of Classification Search ..... 399/101, 399/111, 112, 298, 299, 302, 303
See application file for complete search history.

(56) References Cited

U.S. PATENT DOCUMENTS

| | | | | |
|---|---|---|---|---|
| 7,715,757 | B2 * | 5/2010 | Tanaka et al. | 399/124 |
| 7,853,170 | B2 * | 12/2010 | Ueda et al. | 399/98 |
| 8,019,248 | B2 * | 9/2011 | Takahashi | 399/99 |
| 2008/0038013 | A1 | 2/2008 | Nakano | |
| 2009/0196652 | A1 | 8/2009 | Sakuma | |
| 2009/0226205 | A1 | 9/2009 | Sato et al. | |
| 2009/0285593 | A1 | 11/2009 | Sakuma | |
| 2009/0324279 | A1 | 12/2009 | Miyahara et al. | |
| 2010/0028041 | A1 | 2/2010 | Sakuma | |
| 2010/0074646 | A1 | 3/2010 | Miyahara et al. | |
| 2010/0178078 | A1 | 7/2010 | Tamura et al. | |
| 2010/0209157 | A1 | 8/2010 | Sato et al. | |

FOREIGN PATENT DOCUMENTS

| | | | |
|---|---|---|---|
| JP | 58068083 A | * | 4/1983 |
| JP | 06-003878 | | 1/1994 |
| JP | 2006-091650 | | 4/2006 |
| JP | 2006091650 A | * | 4/2006 |
| JP | 2008-046251 | | 2/2008 |
| JP | 2009-181077 | | 8/2009 |
| JP | 2009-210937 | | 9/2009 |
| JP | 2009-276438 | | 11/2009 |
| JP | 2010-008652 | | 1/2010 |
| JP | 2010-038947 | | 2/2010 |
| JP | 2010-078847 | | 4/2010 |
| JP | 2010-078848 | | 4/2010 |
| JP | 2010-101990 | | 5/2010 |
| JP | 2010-164632 | | 7/2010 |
| JP | 2010-164633 | | 7/2010 |
| JP | 2010-191012 | | 9/2010 |
| JP | 2010-191013 | | 9/2010 |

* cited by examiner

*Primary Examiner* — Robert Beatty
(74) *Attorney, Agent, or Firm* — Banner & Witcoff, Ltd.

(57) ABSTRACT

A image forming device includes a main casing, a photosensitive-member unit including a plurality of photosensitive members aligned in a first direction, and a belt disposed in confrontation with the photosensitive members. The photosensitive-member unit is movable in the first direction with respect to the main casing, and is pulled out of the main casing when pulled in a pull-out direction parallel to the first direction. The photosensitive-member unit is provided with a cleaning member that is disposed on an upstream side of a most-upstream one of the photosensitive members with respect to the pull-out direction. The cleaning member slidingly contacts the belt when the photosensitive-member unit is moved with respect to the main casing. The cleaning member is located at a predetermined position separate from the belt when the photosensitive-member unit is at a mounting position within the main casing.

9 Claims, 19 Drawing Sheets

UP
REAR
FRONT
DOWN 910
911
913
912
142
180
174
183
81B
82
81
85
81A
174
183B 70
81
81B
174
70A
183
UP
LEFT
RIGHT
183A
81A
85
DOWN
174
183B 70
81
81A
70A
85
174
UP
183B
LEFT
RIGHT
DOWN
174

IMAGE FORMING DEVICE HAVING CLEANING MEMBER FOR CLEANING BELT

CROSS REFERENCE TO RELATED APPLICATION

This application claims priority from Japanese Patent Application No. 2010-051606 filed Mar. 9, 2010. The entire content of this priority application is incorporated herein by reference.

TECHNICAL FIELD

The present invention relates to a photosensitive-member unit movable relative to a device body, and also relates to an image forming device including a belt in confrontation with the photosensitive-member unit.

BACKGROUND

There has been known an image forming device including a photosensitive-member unit and a belt. The photosensitive-member unit is movable in a predetermined direction and includes a plurality of photosensitive members aligned in the predetermined direction. The belt is disposed in confrontation with the plurality of photosensitive members. The photosensitive-member unit can be pulled out of a main casing through an opening formed therein.

SUMMARY

In the above-described configuration, such extraneous matters as paper dust and toner on the plurality of photosensitive members may fall on and cling to the belt when the photosensitive-member unit is pulled out.

In view of the foregoing, it is an object of the invention to provide an image forming device capable of cleaning the belt to remove the extraneous matters.

In order to attain the above and other objects, the invention provides an image forming device including a main casing formed with an opening, a photosensitive-member unit disposed at a mounting position within the main casing and including a plurality of photosensitive members aligned in a line along a first direction, and a belt disposed in confrontation with the plurality of photosensitive members. The photosensitive-member unit is movable in the first direction with respect to the main casing, and is pulled out of the main casing through the opening when pulled in a pull-out direction parallel to the first direction. The photosensitive-member unit is provided with a cleaning member that is disposed on an upstream side of a most-upstream one of the photosensitive members with respect to the pull-out direction. The cleaning member slidingly contacts the belt when the photosensitive-member unit is moved with respect to the main casing. The cleaning member is located at a predetermined position separate from the belt when the photosensitive-member unit is at the mounting position.

BRIEF DESCRIPTION OF THE DRAWINGS

The particular features and advantages of the invention as well as other objects will become apparent from the following description taken in connection with the accompanying drawings, in which:

FIG. 2(*b*) is a left side view of the photosensitive-member unit of FIG. 2(*a*);

FIG. 3(*b*) is a perspective phantom view showing the cleaning member at a separate position;

FIG. 16(*b*) is an enlarged partial rear view showing the cleaning member at a separate position;

FIG. 16(*c*) is an enlarged partial rear view showing the cleaning member at the contact position;

DETAILED DESCRIPTION

Figure 1:
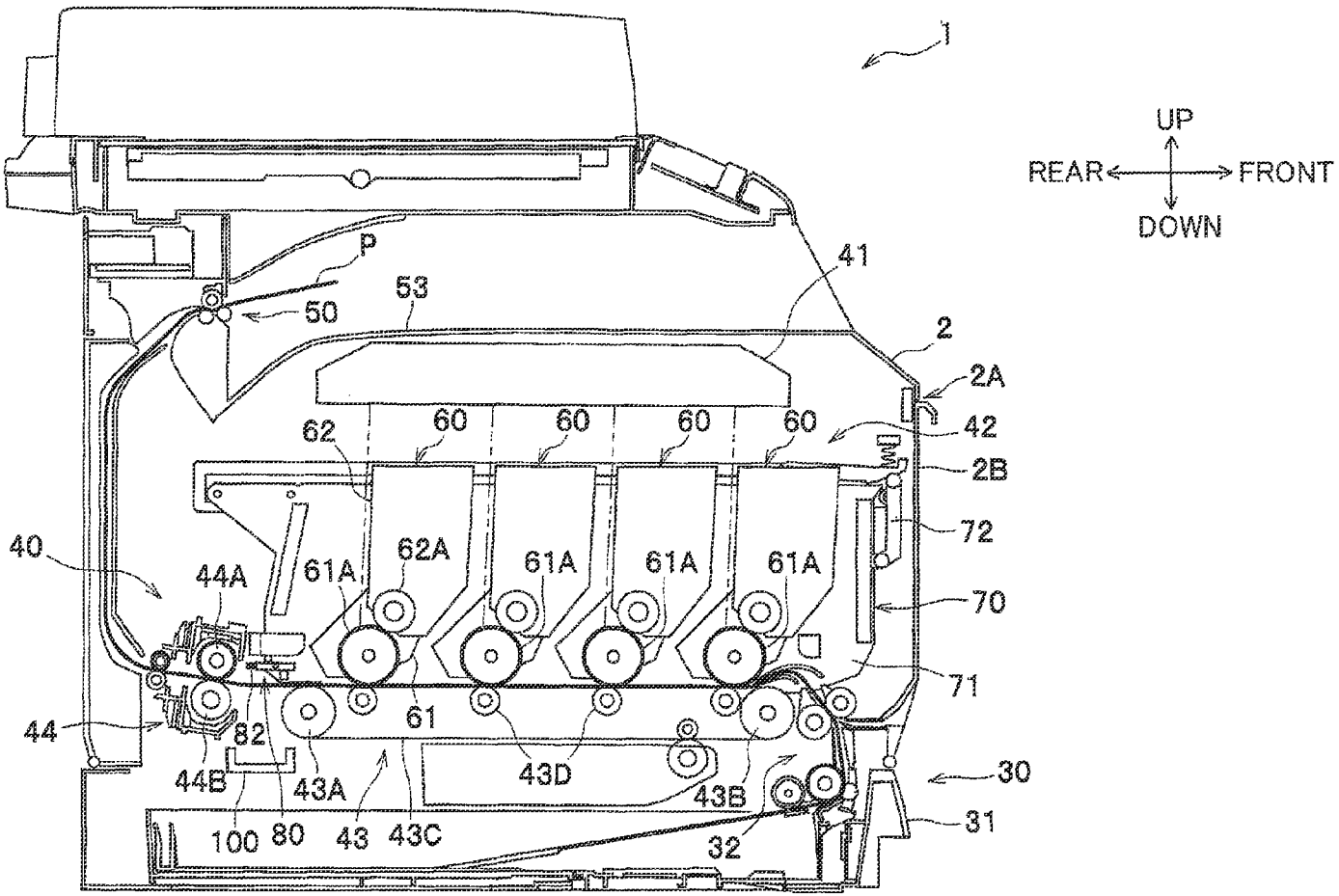
FIG. 1 is a cross-sectional view showing an overall configuration of a color laser printer according to a first embodiment of the invention.

Image forming devices according to embodiments of the invention will be described while referring to the accompanying drawings wherein like parts and components are designated by the same reference numerals to avoid duplicating description.

The terms "upward," "downward," "upper," "lower," "above," "below," "beneath," "right," "left," "front," "rear" and the like will be used throughout the description assuming that an image forming device is disposed in an orientation in which it is intended to be used, unless defined otherwise. In use, the image forming device is disposed as shown in FIG. 1. Also, in order to facilitate understanding of the drawings, only some sections of cross-sectional drawings are hatched as needed.

First, a color laser printer 1 as an image forming device according to a first embodiment of the invention will be described with reference to FIGS. 1 to 12. As shown in FIG. 1, the color laser printer 1 includes a main casing 2 and, within the main casing 2, a paper supply section 30 for supplying a paper sheet P, an image forming section 40 for forming an image on the paper sheet P supplied from the paper supply section 30, and a discharge section 50 for discharging the paper sheet P with the image formed thereon out of the main casing 2.

The paper supply section 30 includes a sheet supply tray 31 freely detachably mounted on the main casing 2 and a sheet supply mechanism 32 for supplying the paper sheet P from the sheet supply tray 31 to the image forming section 40.

The image forming section 40 includes a scanner unit 41, a photosensitive-member unit 42, a transfer unit 43, and a fixing unit 44.

Although not shown in the drawings, the scanner unit 41 includes a laser source, a polygon mirror, a lens, and a reflection mirror, and irradiates photosensitive drums 61A (described later) with laser lights corresponding to colors cyan, magenta, yellow, and black.

The photosensitive-member unit 42 is disposed at a mounting position between the scanner unit 41 and the transfer unit 43 (above a convey belt 43C to be described later), and includes four process cartridges 60 and a drawer 70 detachably supporting each of the process cartridges 60. The process cartridges 60 are aligned in a line along a front-rear direction, in which the paper sheet P is conveyed by the convey belt 43C.

Each process cartridge 60 includes a drum cartridge 61 disposed at a lower section thereof and a developer cartridge 62 detachably attached to the drum cartridge 61 from above.

The drum cartridge 61 includes the photosensitive drum 61A, a charger (not shown), and the like. The plurality of drum cartridges 61 are aligned in the front-rear direction, so the photosensitive drums 61A are also aligned in a line along the front-rear direction.

The developer cartridge 62 includes a developer roller 62A, a supply roller (not shown), a toner accommodating chamber (not shown), and the like. The toner accommodating chamber of the developer cartridge 62 accommodates non-magnetic single component toner of each of the colors cyan, magenta, yellow, and black.

The drawer 70 includes a main frame 71 and a handle 72. The main frame 71 detachably supports the plurality of process cartridges 60. The handle 72 is substantially laterally-facing U-shaped, and is pivotably attached to a front surface of the main frame 71. The main casing 2 is formed with an opening 2A at a front side thereof, and has a front cover 2B for selectively opening and closing the opening 2A. The opening 2A has a sufficient size that the drawer 70 can be dawn to the outside of the main casing 2 through the opening 2A. The drawer 70 is provided movable relative to the main casing 2 in the front-rear direction, and is capable of being pulled out of the main casing 2 through the opening 2A.

In the photosensitive-member unit 42 having the above-described configuration, after uniformly charged to a positive polarity by the charger (not shown), the surface of the photosensitive drum 61A is exposed by a high-speed scanning of laser light from the scanner unit 41. As a result, the electric potential of the exposed part is lowered, and an electrostatic latent image corresponding to image data is formed on the surface of the photosensitive drum 61A.

Subsequently, the toner accommodated in the developer cartridge 62 is selectively supplied to the electrostatic latent image on the surface of the photosensitive drum 61A by the supply roller (not shown) and the developer roller 62A. As a result, the electrostatic latent image is transformed into a visible toner image. In this manner, the toner image is formed by reverse development.

The transfer unit 43 includes a drive roller 43A, a follow roller 43B, the convey belt 43C, and four transfer rollers 43D.

The convey belt 43C is disposed in confrontation with all of the photosensitive drums 61A. The convey belt 43C rotates together with the follow roller 43B when the drive roller 43A is driven to rotate. The transfer rollers 43D are disposed within the convey belt 43C so as to confront the respective photosensitive drums 61A with the convey belt 43C interposed therebetween. Each transfer roller 43D is applied with a transfer bias from a high-voltage board (not shown).

In the transfer unit 43, the toner image formed on each photosensitive drum 61A is transferred onto the paper sheet P being conveyed by the convey belt 43C when the paper sheet P passes through a position between the photosensitive drum 61A and the transfer roller 43D.

The fixing unit 44 includes a heat roller 44A and a pressure roller 44B. The fixing unit 44 thermally fixes the toner image onto the paper sheet P by conveying the paper sheet P while nipping the same between the heat roller 44A and the pressure roller 44B.

The discharge section 50 includes a plurality of convey rollers and conveys the paper sheet P discharged from the fixing unit 44 to a discharge tray 53 formed on top of the main casing 2.

Figure 2A:
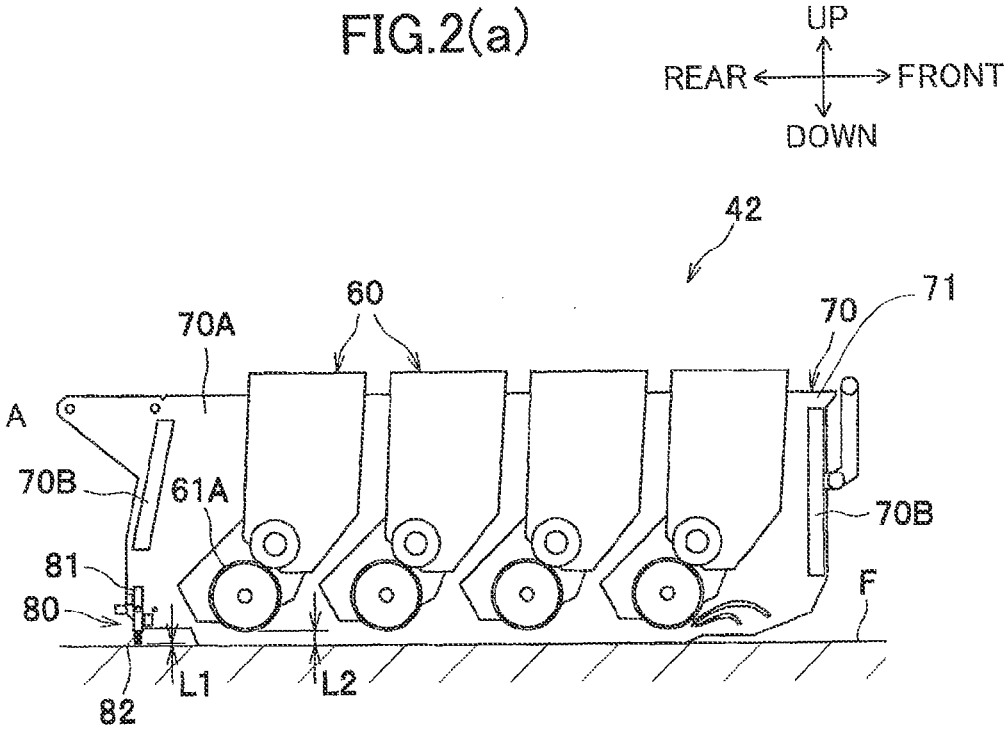
FIG. 2(*a*) is a cross-sectional view of a photosensitive-member unit according to the first embodiment of the invention.
Figure 2B:
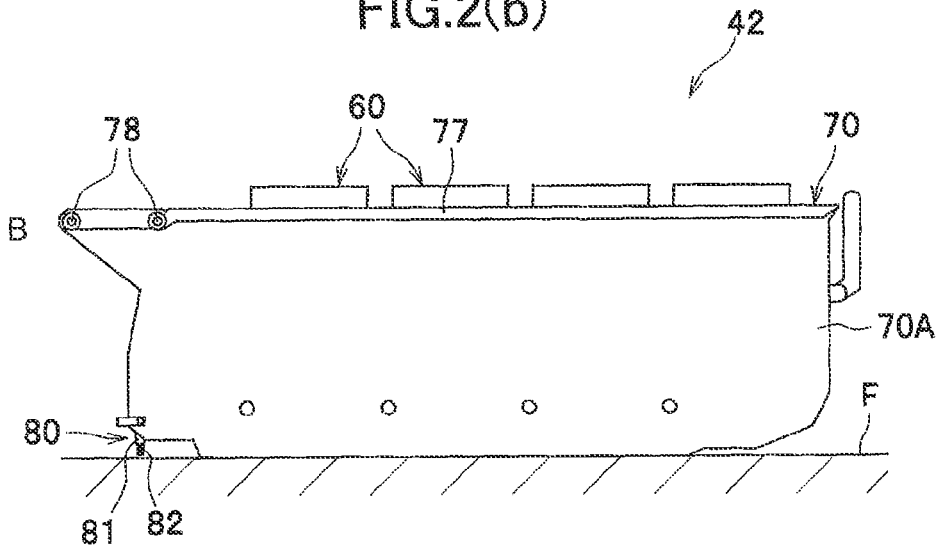

As shown in FIGS. 2(*a*) and 2(*b*), the main frame 71 of the drawer 70 is formed in a rectangular frame shape, and surrounds the process cartridges 60 on the right, left, front, and rear sides. The drawer 70 (the main frame 71) includes a pair of side plates 70A facing each other in the right-left direction and a pair of support plates 70B facing each other in the front-rear direction and supporting the side plates 70A. A cleaning member 80 is disposed at a lower rear of the side plates 70A (more specifically, at a position below the support plate 70B on the rear side).

Figure 4:
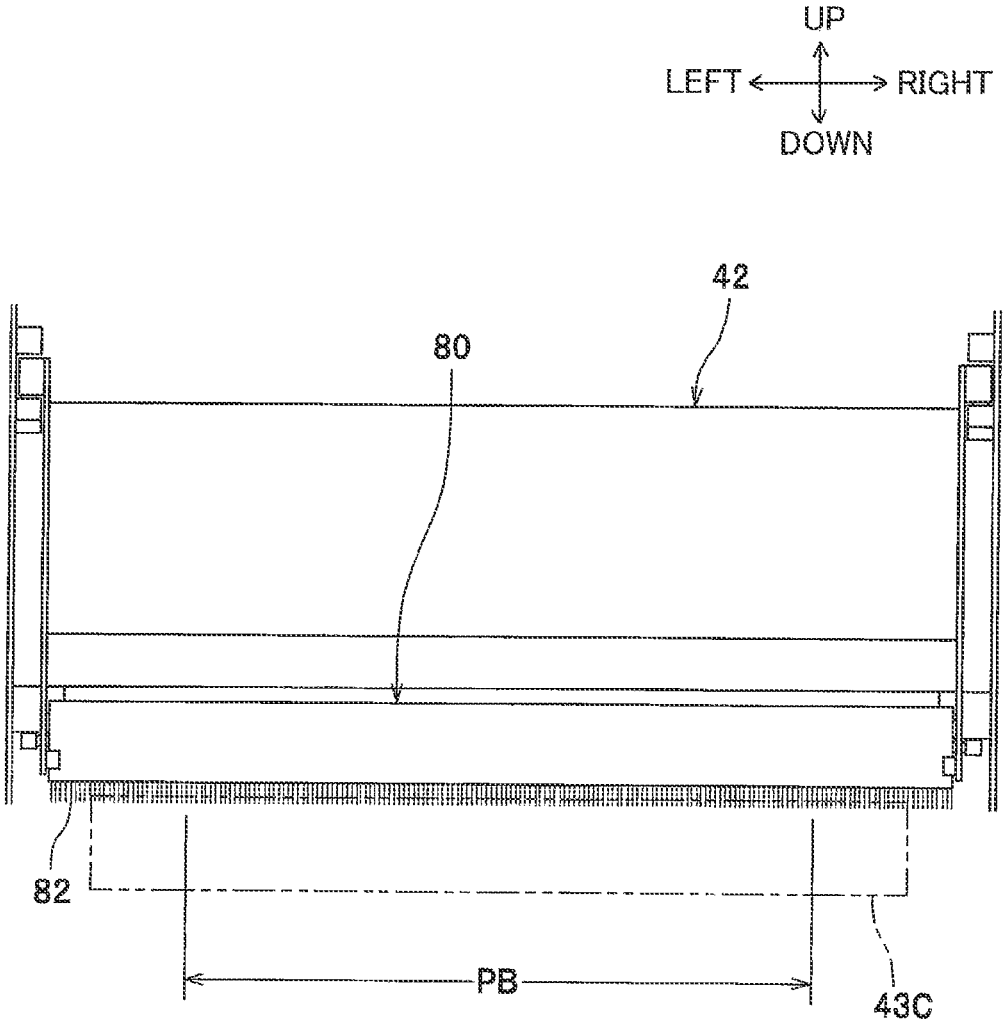
FIG. 4 is an explanatory view showing a relationship between widths of the cleaning member and a convey belt with respect to a width direction of a paper sheet.

The cleaning member 80 is for removing paper dust and toner from the convey belt 43C by slidingly contacting the convey belt 43C. As shown in FIG. 4, the cleaning member 80 includes a base 81 shaped like a plate extending in the right-left direction and a sliding contact member 82 shaped like a brush and disposed at a lower edge of the base 81.

Figure 3A:
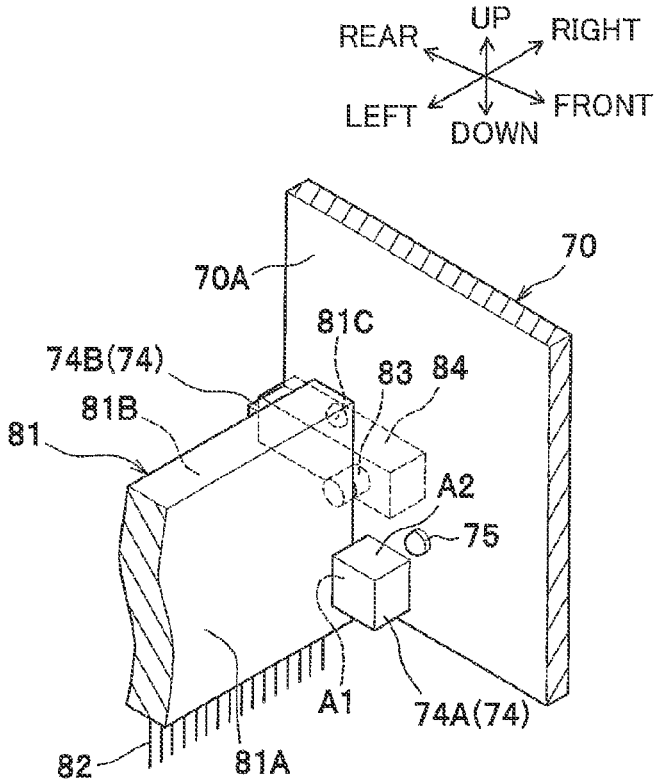
FIG. 3(*a*) is a perspective phantom view showing a cleaning member at a contact position according to the first embodiment of the invention.
Figure 3B:
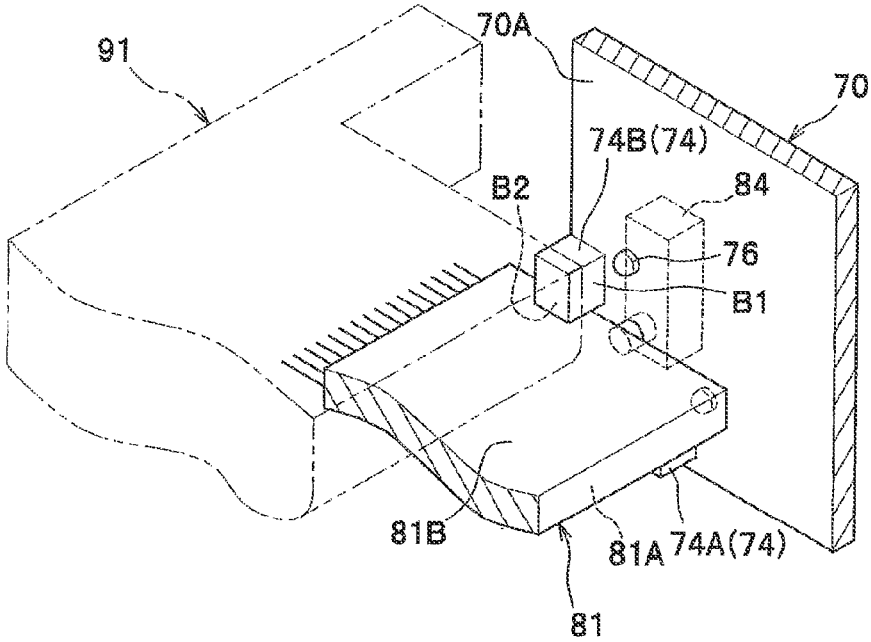

As shown in FIGS. 3(*a*) and 3(*b*), the base 81 is integrally formed with a pivot shaft 83 rotatably supported to the right and left side plates 70A of the drawer 70, and is pivotable about the pivot shaft 83. That is, the cleaning member 80 (more specifically, the sliding contact member 82) is movable relative to the drawer 70 between a contact position shown in FIG. 3(*a*) at which the cleaning member 80 (the sliding contact member 82) can contact the convey belt 43C and a separate position shown in FIGS. 1 and 3(*b*) separate from the convey belt 43C in the diagonally upward and rearward direction.

The pivot shaft 83 penetrates the side plates 70A and protrudes from outer surfaces of the side plates 70A in the right-left direction. Operation parts 84 are fixed to respective outer ends of the pivot shaft 83 projecting outside the side plates 70A in the right-left direction. Each operation part 84 extends in a direction perpendicular to the longitudinal direction of the base 81. Each operation part 84 lies substantially along the horizontal direction with its tip end facing rearward when the sliding contact member 82 is at the contact position as shown in FIG. 3(*a*), and is upright substantially along an up-down direction with the tip end facing upward when the sliding contact member 82 is at the separate position as shown in FIG. 3(*b*).

A pair of regulation members 74 is formed on an inner surface of each side plate 70A so as to protrude inward in the right-left direction. The regulation members 74 are for regulating a pivot range of the cleaning member 80 to a range between the contact position and the separate position by contacting a front surface 81A or a rear surface 81B of the base 81. The regulation members 74 are positioned so as to sandwich the base 81 of the cleaning member 80 at the contact position therebetween in the front-rear direction and to sandwich the base 81 of the cleaning member 80 at the separate position therebetween in the up-down direction.

More specifically, the regulation members 74 include a regulation member 74A and a regulation member 74B. The regulation member 74A has a first abutting surface A1 that abuts a lower section of the front surface 81A of the base 81 when the cleaning member 80 pivots to the contact position and a second abutting surface A2 that abuts an upper section of the front surface 81A when the cleaning member 80 pivots to the separate position. The regulation member 74B has a first abutting surface B1 that abuts an upper section of the rear surface 81B of the base 81 when the cleaning member 80 pivots to the contact position and a second abutting surface B2 that abuts a lower section of the rear surface 81B when the cleaning member 80 pivots to the separate position.

Note that the terms "upper," "lower," and the like are used for describing the cleaning member 80 assuming the cleaning member 80 is at the contact position as shown in FIG. 3(*b*).

A first engaging protrusion 75 (FIG. 3(*a*)) and a second engaging protrusion 76 (FIG. 3(*b*)) are also formed on the inner surface of each side plate 70A. The first engaging protrusion 75 is disposed diagonally upward and frontward of the regulation member 74A (between the regulation members 74 in the up-down direction). The first engaging protrusion 75 is for maintaining the cleaning member 80 at the separate position by engaging with a recess 81C (FIG. 3(*a*)) formed on an outer surface of the base 81 with respect to the right-left direction. The second engaging protrusion 76 is disposed diagonally upward and frontward of the regulation member 74B (between the regulation members 74 in the front-rear direction). The second engaging protrusion 76 is for maintaining the cleaning member 80 at the contact position by engaging with the recess 81C. Note that the recess 81C and the first engaging protrusion 75 together function as a separate-position-maintaining mechanism.

As shown in FIG. 2(*a*), there is a distance L1 between the sliding contact member 82 at the contact position and a lower edge of the side plate 70A in the up-down direction, and there is a distance L2 between the photosensitive drum 61A and the lower edge of the side plate 70A in the up-down direction, which is greater than the distance L1. Thus, even when the photosensitive-member unit 42 detached from the main casing 2 is placed on a surface F of a floor or a desk, the photosensitive drums 61A and the sliding contact member 82 do not contact the surface F. Therefore, the surface F can be prevented from being smeared with toner or the like. Also, because the photosensitive drums 61A are located farther away from the lower edge of the side plate 70A than the sliding contact member 82, only the sliding contact member 82 can slidingly contact the convey belt 43C in an inserting operation for inserting the photosensitive-member unit 42 into the main casing 2 as described later, while preventing the photosensitive drums 61A from contacting the convey belt 43C in the inserting operation.

As shown in FIG. 4, the sliding contact member 82 has a wider width than a width of the convey belt 43C (and a width of the paper sheet P) in the right-left direction. Thus, the sliding contact member 82 can clean the entire width of the convey belt 43C in a preferable manner. Note that the sliding contact member 82 does not necessarily have such width, as long as the width of the sliding contact member 82 is wider than a printing width PB of the photosensitive drum 61A.

Note that the "printing width PB of the photosensitive drum 61A" denotes a maximum width (dimension in a direction perpendicular to a sheet conveying direction) of the toner image to be transferred from the photosensitive drum 61A to the paper sheet P. With the width of the sliding contact member 82 equal to or wider than the printing width PB, the cleaning member 80 can reliably clan sections of the convey belt 43C on which toner is highly likely clings.

Figure 5:
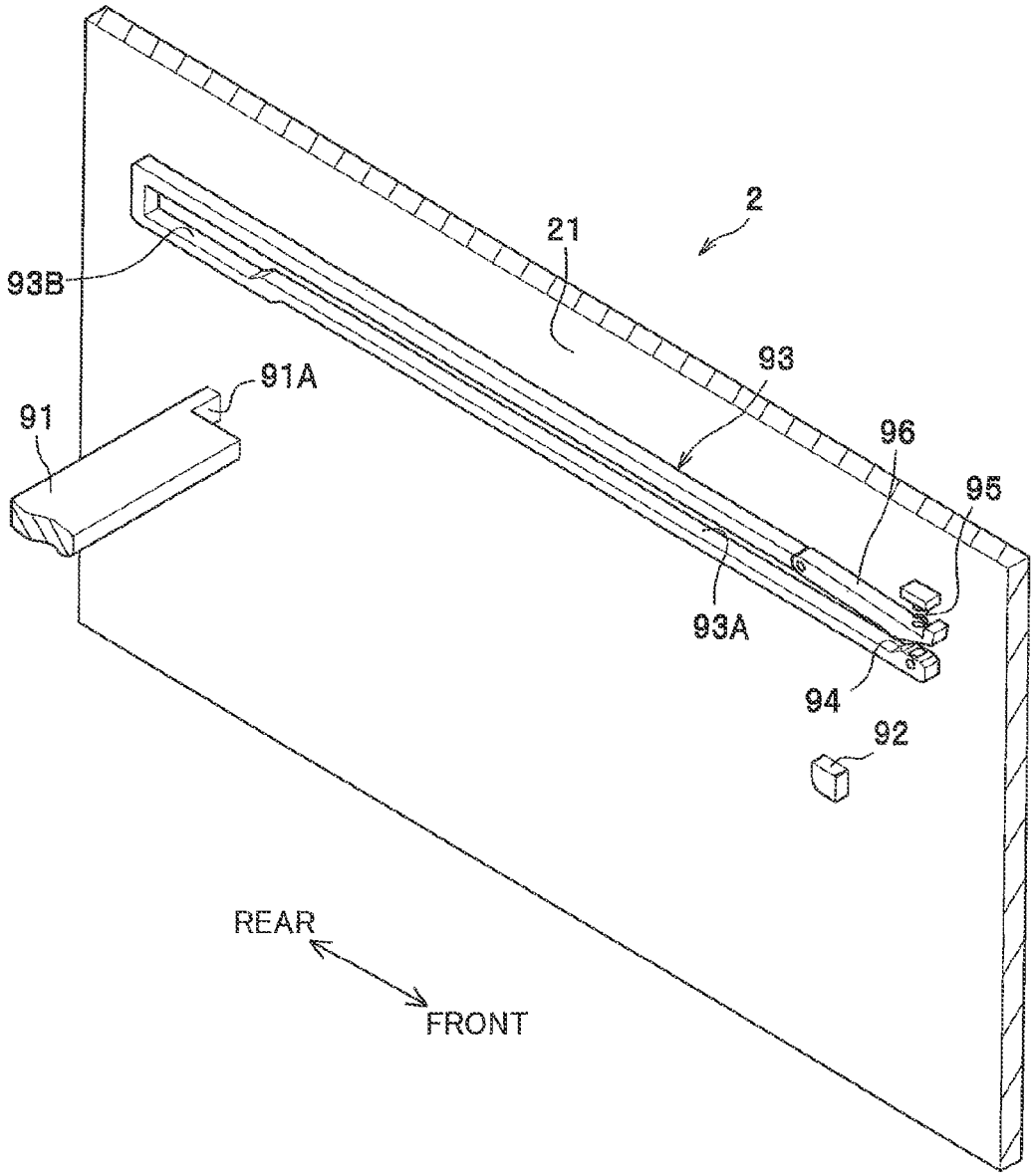
FIG. 5 is a perspective view showing a guide rail and abutting members provided to a main casing of the color laser printer according to the first embodiment of the invention.
Figure 6:
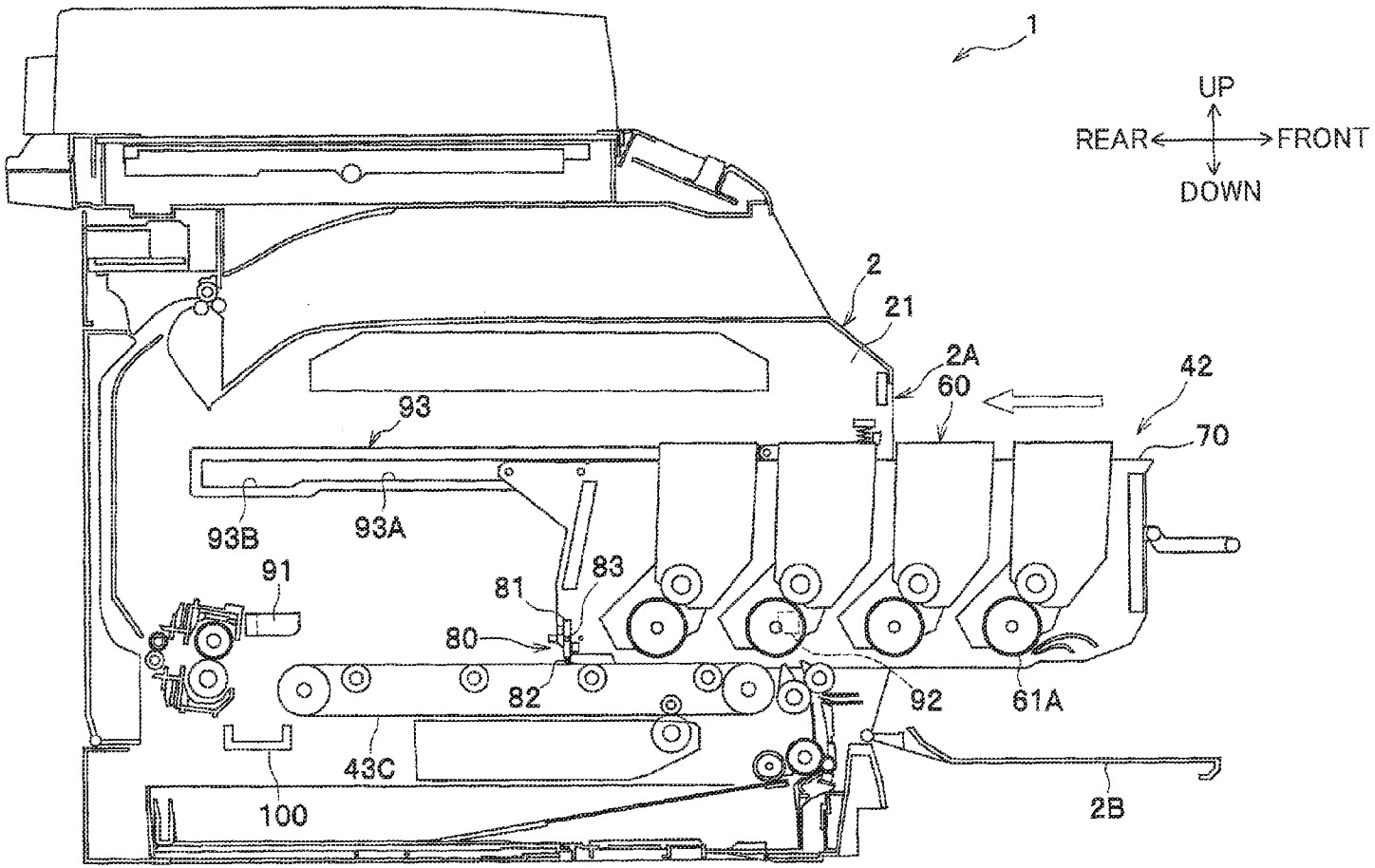
FIG. 6 is a cross-sectional side view of the color laser printer with the cleaning member slidingly contacting the convey belt when the photosensitive-member unit is inserted into the main casing.
Figure 7:
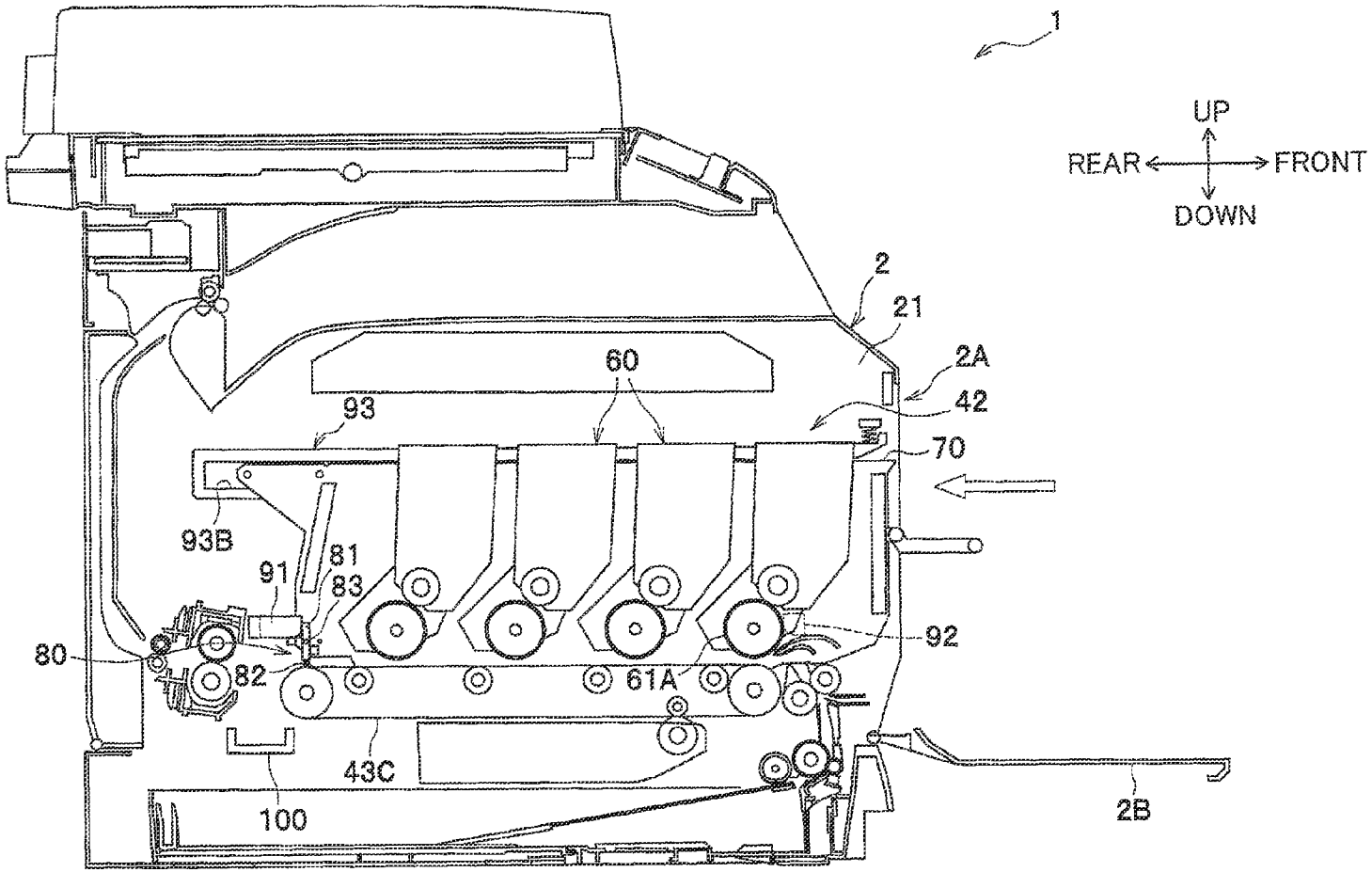
FIG. 7 is a cross-sectional side view of the color laser printer with the cleaning member abutting a first abutting member.

As shown in FIG. 5, the main casing 2 includes a pair of right and left side walls 21 (only one of which is shown in FIG. 5), a first abutting member 91, a pair of second abutting members 92 (only one of which is shown), and a pair of guide rails 93 (only one of which is shown). The first abutting member 91 is a plate-shaped member extending in the right-left direction between the side walls 21 of the main casing 2. As shown in FIGS. 6 and 7, the first abutting member 91 is located at a position overlapping with the upper section of the base 81 of the cleaning member 80 at the contact position with respect to the front-rear direction. In other words, the first abutting member 91 is positioned such that the first abutting member 91 can abut in the front-rear direction the upper section of the base 81 of the cleaning member 80 when the photosensitive-member unit 42 is supported on the guide rails 93 (more specifically, first support surfaces 93A) as described later.

The cleaning member 80 is configured such that the sliding contact member 82 slidingly contacts the convey belt 43C when the photosensitive-member unit 42 is moved rearward toward the mounting position in the main casing 2 as sequentially shown in FIGS. 6 and 7 in the inserting operation, thereby sweeping such extraneous matters as toner toward the rear.

Figure 8:
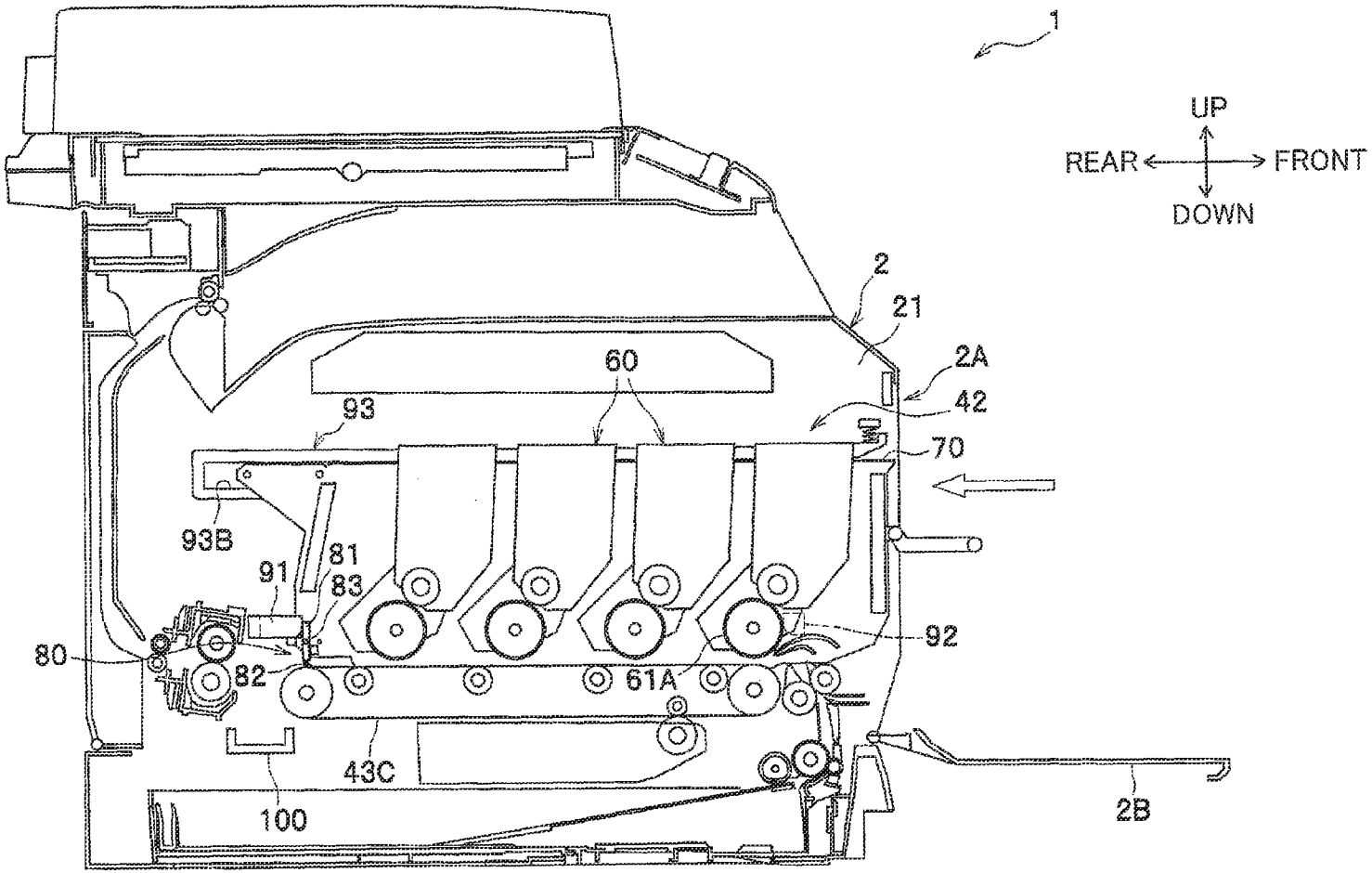
FIG. 8 is a cross-sectional side view of the color laser printer with the cleaning member retracted to the separate position.

Also, as shown in FIG. 7, the upper section of the base 81 of the cleaning member 80 abuts the first abutting member 91 immediately before the photosensitive-member unit 42 reaches the mounting position, and thus the cleaning member 80 pivots to the separate position as shown in FIG. 8. That is, in this embodiment, the base 81 of the cleaning member 80 and the first abutting member 91 together function as a retracting mechanism that retracts the cleaning member 80 from the contact position to the separate position near a position where the cleaning member 80 is located when the photosensitive-member unit 42 is at the mounting position. Thus, the cleaning member 80 is located at a position separate from the convey belt 43C when the photosensitive-member unit 42, to which the cleaning member 80 is attached, is located at the mounting position.

Because the cleaning member 80 (the sliding contact member 82) retracts from the contact position to the separate position rearward of the contact position (i.e., on an upstream side of the contact position with respect to a pull-out direction in which the photosensitive-member unit 42 is pulled out of the main casing 2), the cleaning member 80 sweeps out the extraneous matters on the convey belt 43C toward the rear by pivoting (retracting) to the separate position.

The extraneous matters swept rearward is collected into a collect member 100 shaped like a container and disposed diagonally rearward and downward of the convey belt 43C.

More specifically, the collect member 100 is disposed below the cleaning member 80 located at the mounting position (more specifically, below the sliding contact member 82 of the cleaning member 80 at the separate position when the photosensitive-member unit 42 is located at the mounting position as shown in FIGS. 1 and 8). Thus, even if extraneous matters fall off the sliding contact member 82 of the cleaning member 80 at the separate position over time, the fallen extraneous matters are reliably received by the collect member 100.

As shown in FIG. 5, the first abutting member 91 is formed with clearances 91A at both right and left ends thereof for avoiding the first abutting member 91 interfering with the side plates 70A and the operation parts 84 located at the right and left sides of the drawer 70.

Figure 9:
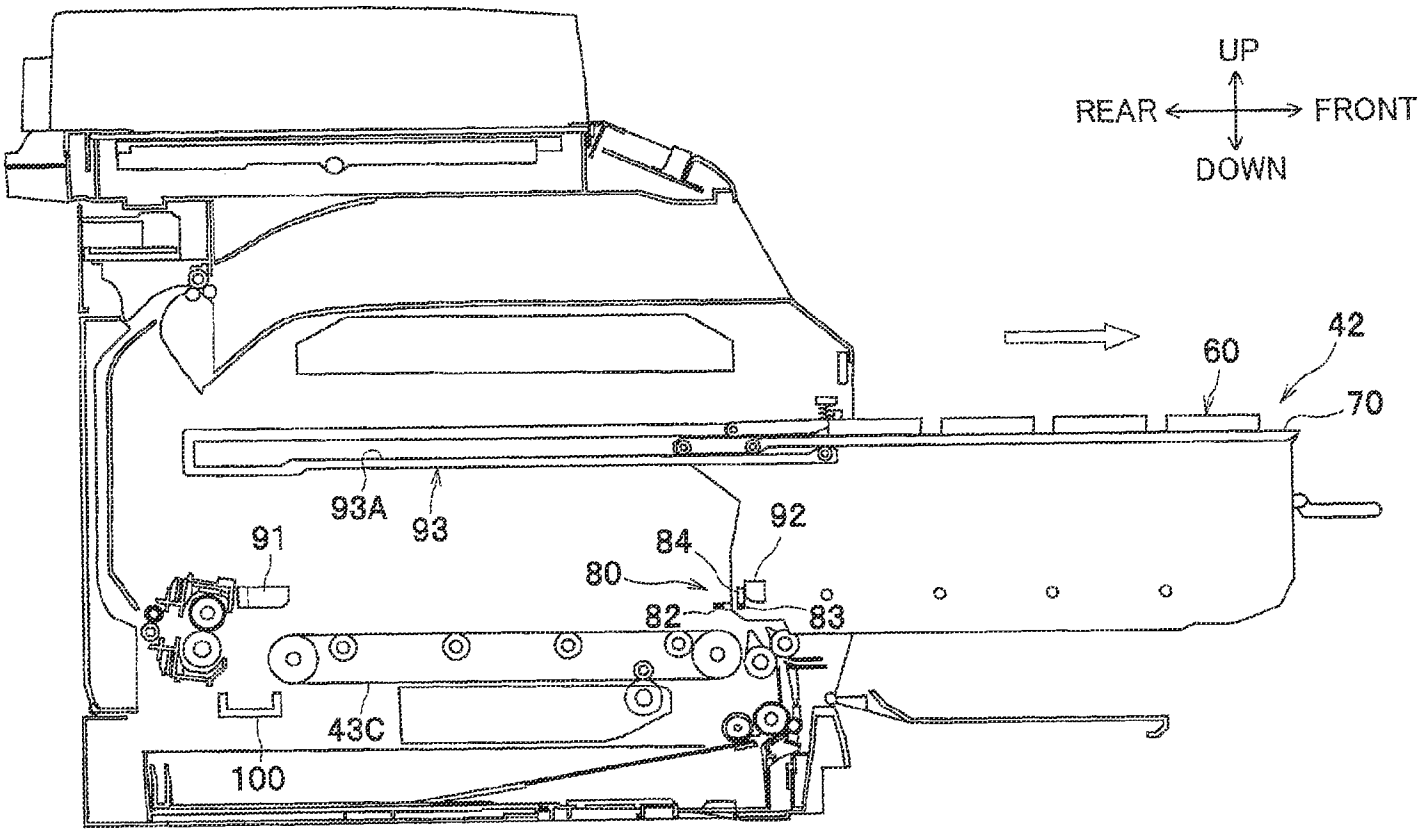
FIG. 9 is a cross-sectional side view of the color laser printer with the cleaning member abutting a second abutting member when the photosensitive-member unit is pulled out of the main casing.

The second abutting members 92 are formed on inner surfaces of the side walls 21 near the opening 2A (see FIG. 8) and capable of abutting the operation parts 84 of the cleaning member 80 (FIG. 3(*a*)) in the front-rear direction. More specifically, as shown in FIG. 9, each second abutting member 92 is disposed at a position overlapping with an upper section of the corresponding operation part 84 (a section of the operation part 84 above the pivot shaft 83) of the cleaning member 80 at the separate position with respect to the front-rear direction. In other words, the second abutting member 92 can abut the upper section of the operation part 84 in the front-rear direction when the drawer 70 is supported on the guide rails 93 (specifically, on the first support surfaces 93A) as described later.

Figure 10:
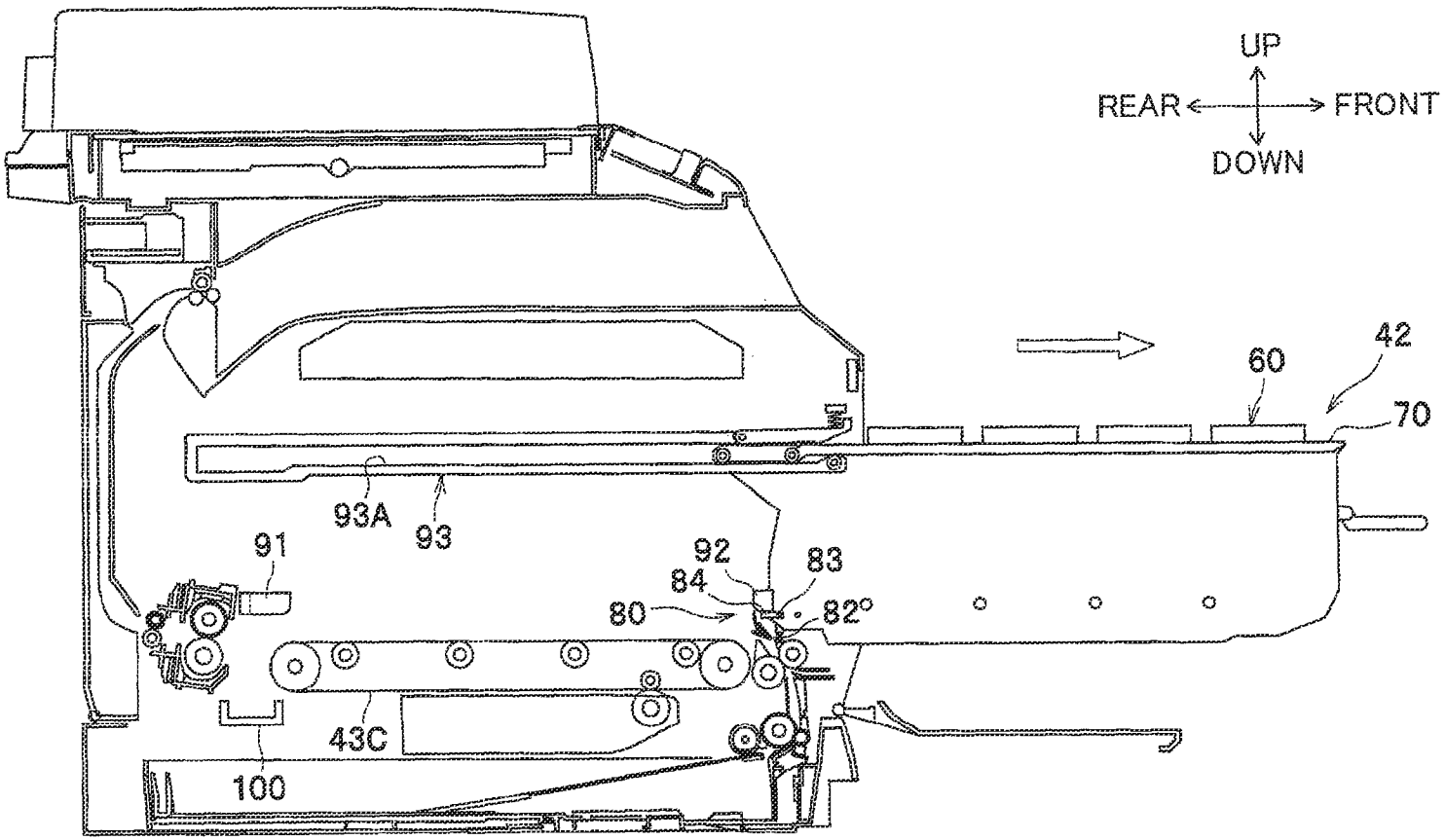
FIG. 10 is a cross-sectional side view of the color laser printer with the cleaning member returned to the contact position.

Thus, when the photosensitive-member unit 42 is pulled out frontward from the mounting position as sequentially shown in FIGS. 8 to 10, the upper sections of the operation parts 84 of the cleaning member 80 abut the second abutting members 92 as shown in FIG. 9, and the cleaning member 80 swings back to the contact position as shown in FIG. 10. That is, in this embodiment, the second abutting members 92 and the operation parts 84 together function as a returning mechanism that returns the cleaning member 80 from the separate position to the contact position when the cleaning member 80 reaches near the opening 2A.

As shown in FIG. 5, the guide rails 93 are disposed on the inner surfaces of the side walls 21 of the main casing 2, and each guide rail 93 has the first support surface 93A and a second support surface 93B formed lower than the first support surface 93A.

Figure 11:
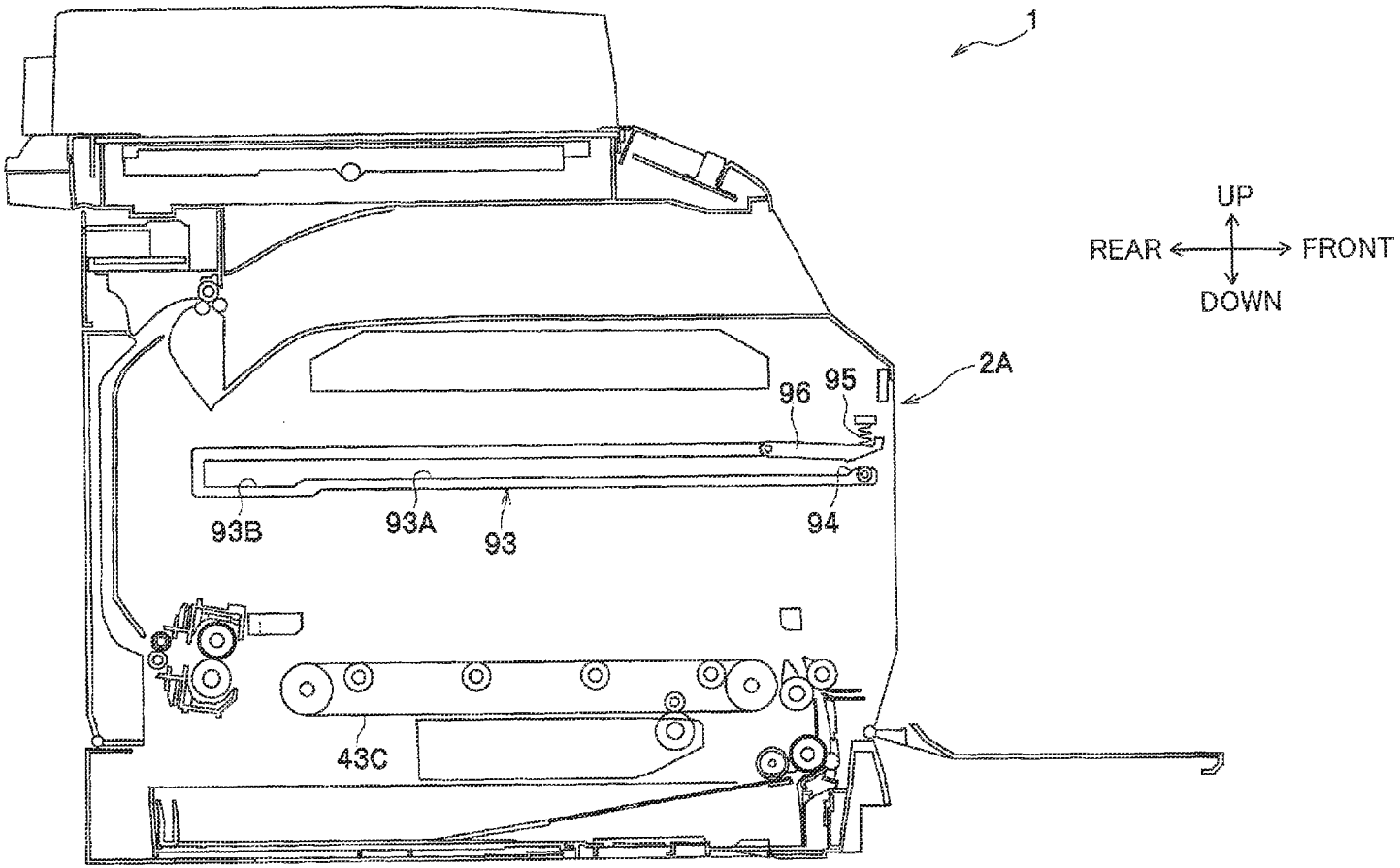
FIG. 11 is a cross-sectional side view of the color laser printer with the photosensitive-member unit removed.

As shown in FIG. 11, the first support surface 93A is formed to extend along the front-rear direction from a position near the opening 2A to a position near a rear end of the convey belt 43C. As shown in FIG. 6, height positions of the first support surfaces 93A are determined such that the sliding contact member 82 of the cleaning member 80 at the contact position slidingly contacts the convey belt 43C during the inserting operation for inserting the photosensitive-member unit 42 to the mounting position in a state that the guide rails 93 support the drawer 70 on the first support surface 93A, but the photosensitive drums 61A do not contact the convey belt 43C during this operation.

This configuration prevents the convey belt 43C from being smeared with toner by contacting the photosensitive drums 61A.

As shown in FIG. 2(*b*), each side plate 70A of the drawer 70 is provided with a flange 77 at an upper edge thereof and a pair of wheels 78 at a rear section of the flange 77. The flange 77 extends outward in the right-rear direction, and has a lower stepped surface in conformity with the first and second support surfaces 93A and 93B.

Thus, as shown in FIGS. 6 and 7, the photosensitive-member unit 42 can move smoothly during the inserting operation with the pairs of wheels 78 rotating on the first support surfaces 93A. When the pairs of wheels 78 reach and drop on the second support surfaces 93B, the flanges 77 are supported on both the first support surfaces 93A and the second support surfaces 93B, and thus the photosensitive-member unit 42 is supported at the mounting position as shown in FIG. 1.

Figure 12:
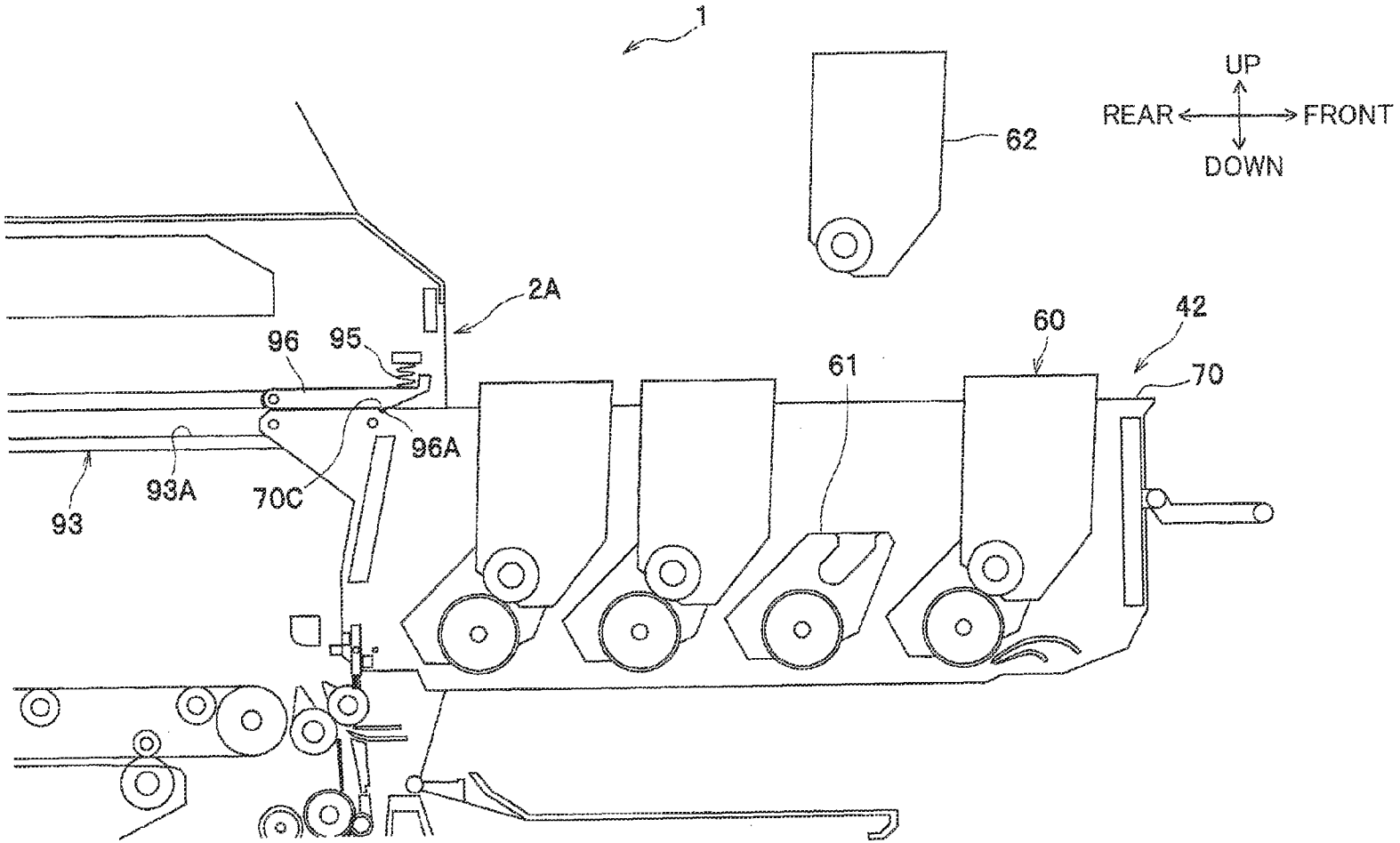
FIG. 12 is a cross-sectional side view of the color laser printer with one developer cartridge detached from the photosensitive-member unit pulled out of the main casing.

As shown in FIG. 11, each guide rail 93 has a stopper 94 protruding upward from a front end of the first support surface 93A and a pivot arm 96 disposed above the front end of the first support surface 93A. The pivot arm 96 is constantly urged toward the stopper 94 by a coil spring 95. As shown in FIG. 12, each pivot arm 96 is formed with a protrusion 96A at a front section thereof for regulating a front-rear movement of the drawer 70 by engaging with corresponding one of grooves 70C formed on a rear section of an upper surface of the drawer 70.

With this configuration, when the photosensitive-member unit 42 is pulled frontward from the mounting position, the wheels 78 catch on the stoppers 94, and the protrusions 96A engage with the grooves 70C, so the photosensitive-member unit 42 is prevented from being detached from the main casing 2. Thus, the process cartridges 60 (the developer cartridge 62 as shown in FIG. 12, for example) can be replaced in a state where the photosensitive-member unit 42 is pulled out of the photosensitive-member unit 42 through the opening 2A as shown in FIG. 12.

Note that a user can detach the photosensitive-member unit 42 from the main casing 2 by pulling the drawer 70 upward against the urging force of the coil springs 95 from the state shown in FIG. 12.

According to the above-described embodiment, even if extraneous matters fall off the photosensitive drums 61A onto the convey belt 43C during a pull-out operation for pulling the photosensitive-member unit 42 out of the main casing 2 through the opening 2A, the cleaning member 80 cleans the convey belt 43C when the photosensitive-member unit 42 is inserted back to the mounting position after maintenance has been performed on the cleaning member 80, for example (or when a new photosensitive-member unit 42 is inserted to the mounting position).

Also, because the cleaning member 80 separates from the convey belt 43C when the photosensitive-member unit 42 reaches the mounting position in the main casing 2, extraneous matters held on the cleaning member 80 do not transfer back onto the convey belt 43C during printing operations or the like, and also the cleaning member 80 does not interfere with rotation of the convey belt 43C.

Because the cleaning member 80 retracts from the contact position to the separate position near the mounting position, abutment between the paper sheet P conveyed by the convey belt 43C and the cleaning member 80 can be prevented, so paper jam can be prevented.

During the pull-out operation for pulling the photosensitive-member unit 42 frontward from the mounting position, the cleaning member 80 is maintained at the separate position by the engagement between the recesses 81C and the first engaging protrusions 75. Thus, toner held on the cleaning member 80 can be prevented from contacting the convey belt 43C to smear the same in the pull-out operation. Also, the configuration of the embodiment can prevent toner and the like collected by the cleaning member 80 from accumulating at a midsection on the convey belt 43C when the photosensitive-member unit 42 has been only pulled halfway for, for example, replacing one developer cartridge 62.

Because the cleaning member 80 is returned to the contact position by the second abutting members 92 when the photosensitive-member unit 42 is pulled out all the way to a pulled-out position shown in FIG. 10, the user can clean the cleaning member 80 by removing the extraneous matters from the sliding contact member 82 without pivoting the cleaning member 80, and also the cleaning member 80 can clean the convey belt 43C when the photosensitive-member unit 42 is inserted to the mounting position without requiring the user to pivot the cleaning member 80 to the contact position.

Because the width of the sliding contact member 82 is wider than the printing width PB, the cleaning member 80 can reliably clean a section of the convey belt 43C where toner clings with a relatively high probability.

Because the cleaning member 80 is pivotably (swingably) provided to the photosensitive-member unit 42 and configured to sweep extraneous matters on the convey belt 43C rearwards, the cleaning member 80 can reliably clean the convey belt 43C.

Because the collect member 100 is disposed beneath the cleaning member 80 at the mounting position, the collect member 100 can receive the extraneous matters fallen off the cleaning member 80 at the mounting position. The collect member 100 also can receive the extraneous matters swept rearward from the convey belt 43C as the cleaning member 80 pivots from the contact position to the separate position.

While the invention has been described in detail with reference to the first embodiment thereof, it would be apparent to those skilled in the art that various changes and modifications may be made therein without departing from the spirit of the invention.

For example, in the above-described first embodiment, the cleaning member 80 is configured to pivot between the contact position and the separate position by abutting the first abutting members 91 near the mounting position or the second abutting members 92 near the opening 2A. However, this is not limitation of the invention. For example, the invention can employ a configuration described next as a second embodiment.

Figure 13:
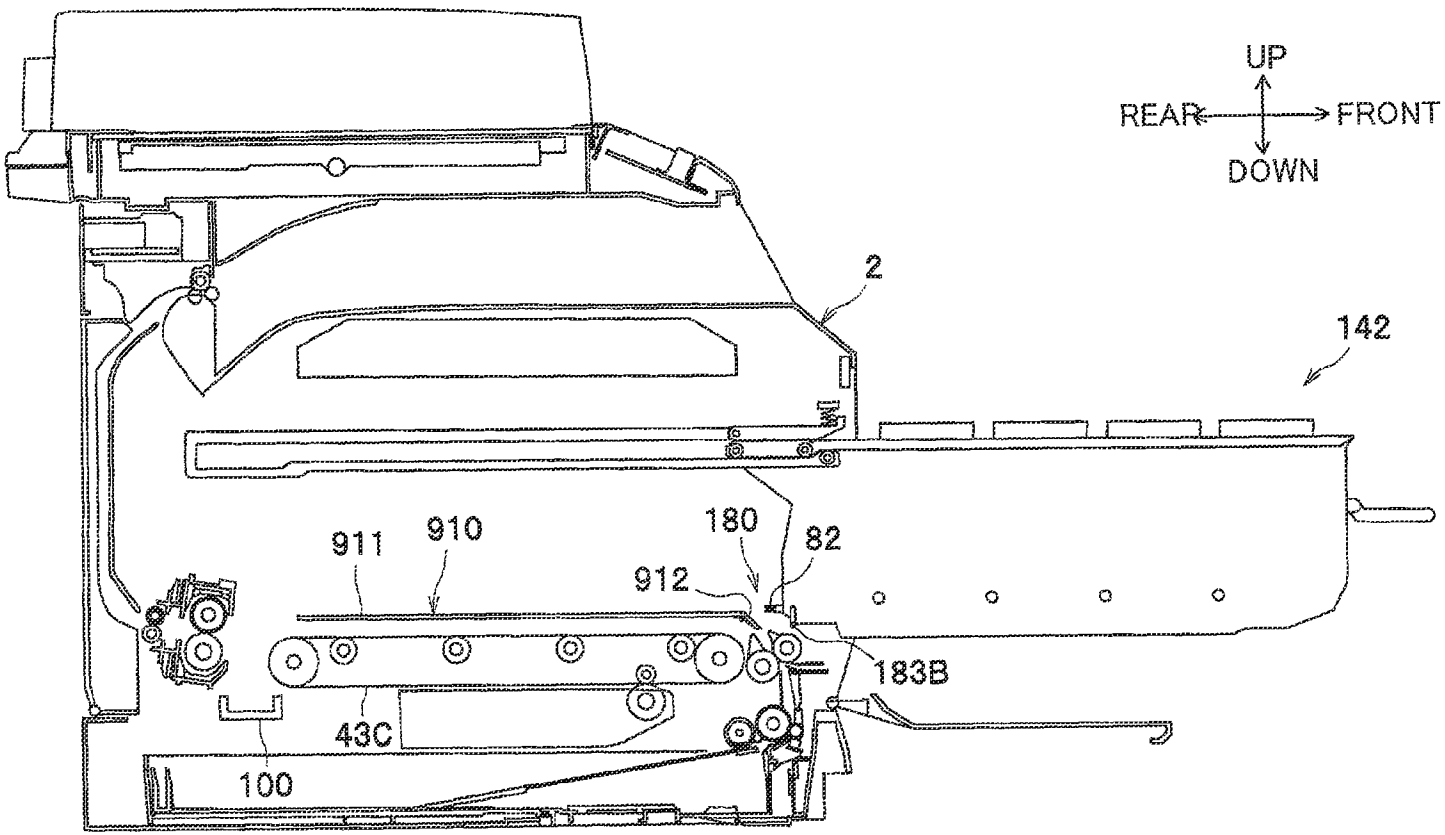
FIG. 13 is a cross-sectional side view of a color laser printer according to a second embodiment of the invention, with a photosensitive-member unit pulled out of a main casing to a maximum extent.

As shown in FIG. 13, a color laser printer 1A according to the second embodiment of the invention includes a photosensitive-member unit 142 and a cleaning member 180, instead of the photosensitive-member unit 42 and the cleaning member 80.

Figure 16A:
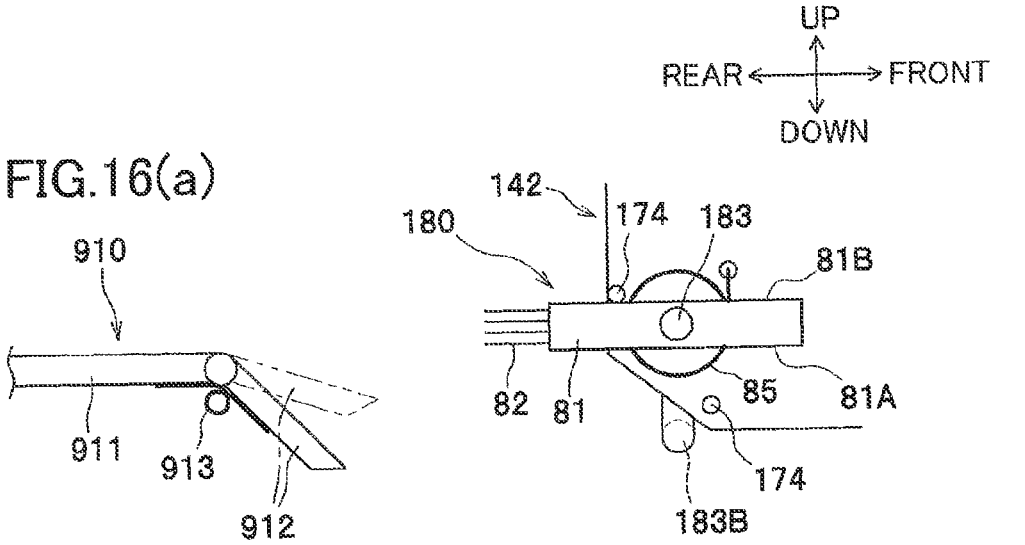
FIG. 16(*a*) is an enlarged partial side view showing the cleaning member and the engaging member.
Figure 16B:
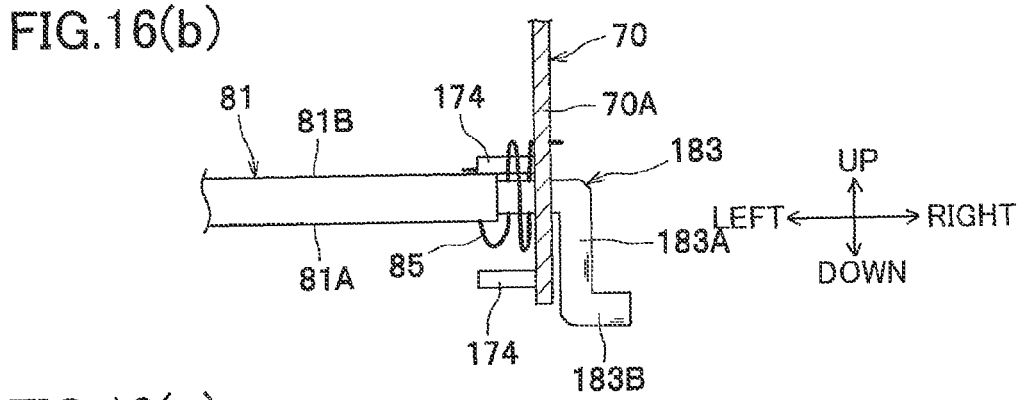
Figure 16C:
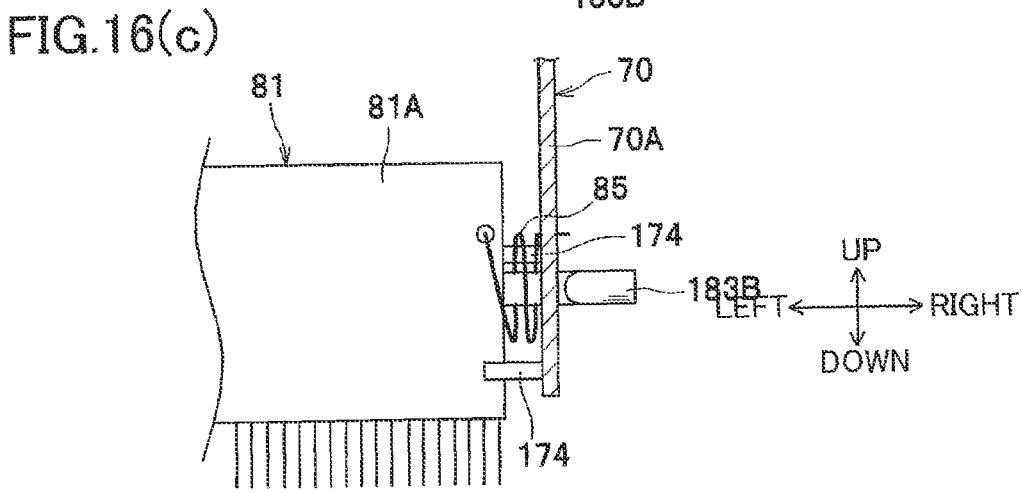

As shown in FIG. 16(*a*), the cleaning member 180 includes the base 81, the sliding contact member 82, and a pivot shaft 183.

As shown in FIG. 16(*b*), the pivot shaft 183 is formed with protruding parts 183A, each protrudes outward from the corresponding side plate 70A of the drawer 70 in the right-left direction and bends in a direction perpendicular to the longitudinal direction of the base 81 (i.e., bends downward when the cleaning member 80 is at the separate position as shown in FIG. 16(*b*)). Each protruding part 183A is formed with an abutting part 183B that extends from an end of the protruding part 183A outward in the right-left direction.

Figure 14:
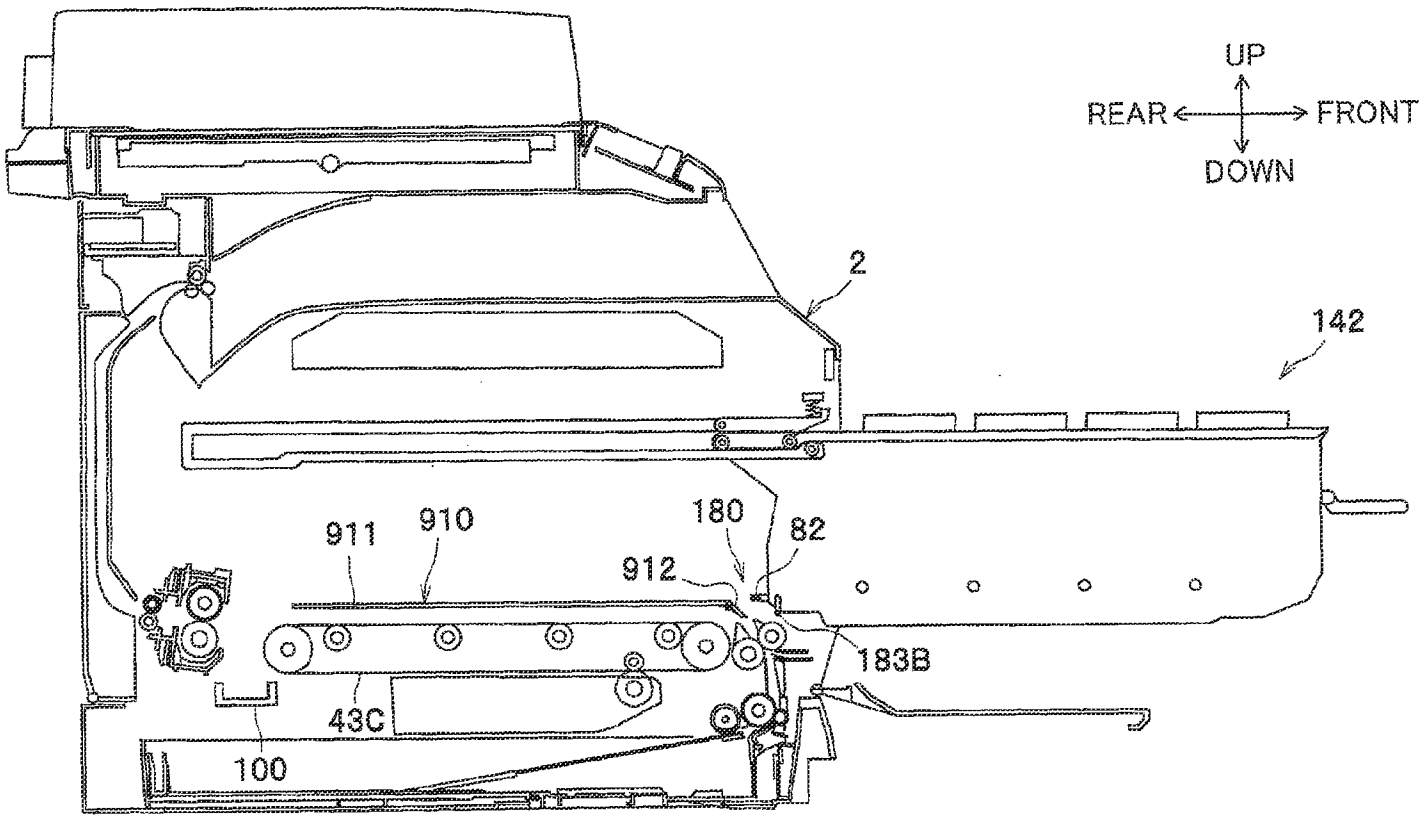
FIG. 14 is a cross-sectional side view of the color laser printer according to the second embodiment with a cleaning member starting pivoting by engaging with an engaging member.
Figure 15:
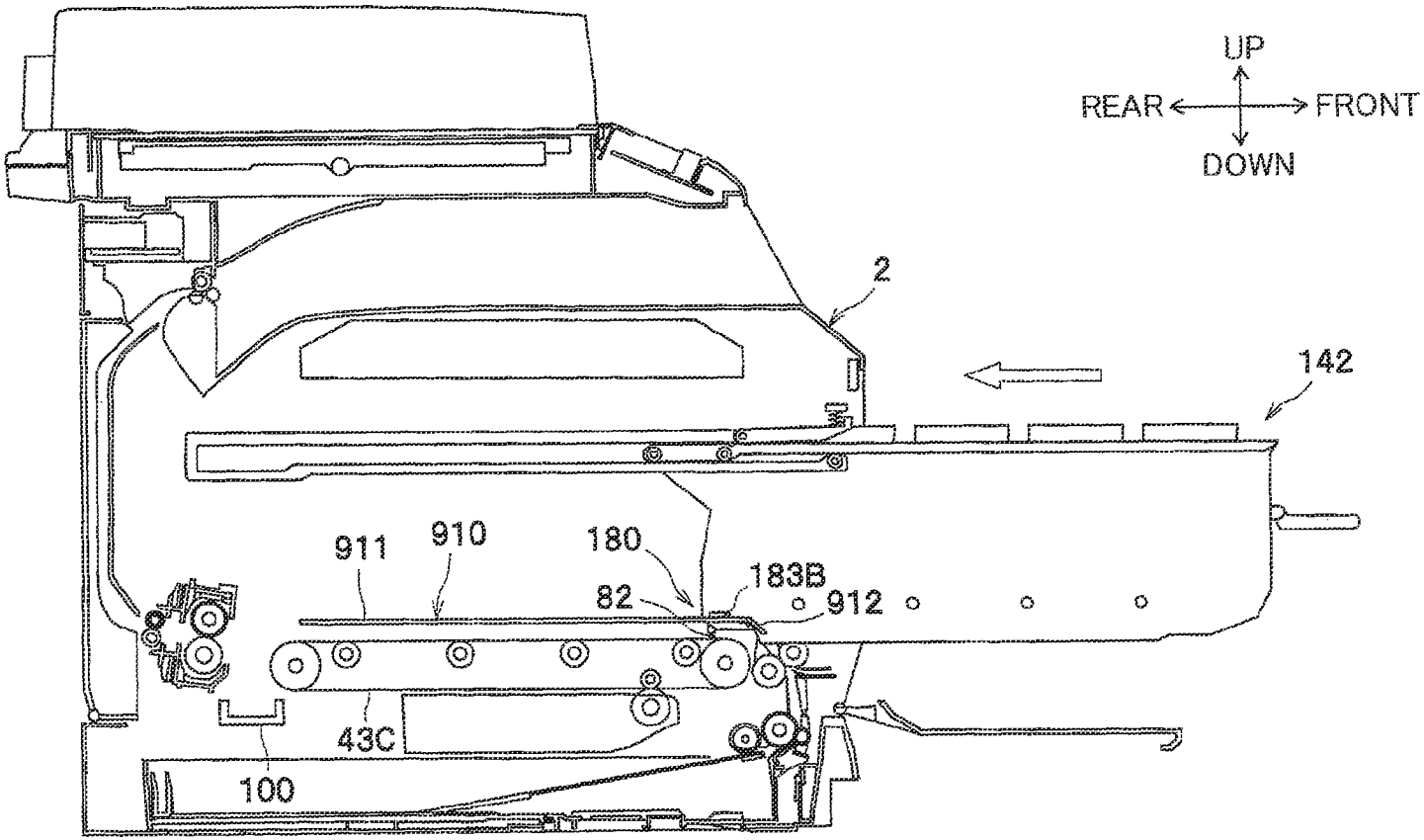
FIG. 15 is a cross-sectional side view of the color laser printer according to the second embodiment with the cleaning member maintained at a contact position.

As shown in FIGS. 13 to 15, when the abutting parts 183B engage with engaging members 910 (more specifically, pivot-engaging members 912) to be described later during the inserting operation for inserting the photosensitive-member unit 142 to the mounting position, the abutting parts 183B are pivoted diagonally upward and frontward by the engaging members 910. As a result, the cleaning member 180 (the sliding contact member 82) pivots from the separate position to the contact position.

Also, as shown in FIGS. 16(*a*) to 16(*c*), a pair of regulation pins 174 is disposed on the inner surface of each side plate 70A of the drawer 70 so as to protrude inward. The regulation pins 174 are for regulating the pivot range of the cleaning member 80 to a range between the contact position and the separate position by abutting the front surface 81A or the rear surface 81B. Note that the regulation pins 174 differ from the regulation members 74 of the above-described first embodiment in shape, but functions and locations thereof are substantially the same as those of the regulation members 74.

In this embodiment, the recesses 81C and the first and second engaging protrusions 75 and 76 are not provided. Instead, a coil spring 85 is disposed between the base 81 and the side plate 70A for constantly urging the base 81 toward the separate position (toward one of the regulation pins 174 at a higher position) so as to maintain the cleaning member 180 at the separate position. Thus, when the photosensitive-member unit 142 is detached out from the main casing 2, the cleaning member 180 is maintained at the separate position. Therefore, the cleaning member 180 is reliably prevented from causing dirtying of the desk or the like when the detached photosensitive-member unit 142 is placed on the desk or the like.

As shown in FIG. 13, the main casing 2 is provided with the engaging members 910 for bringing the cleaning member 180 to the contact position against the urging force of the coil spring 85 by engaging with the cleaning member 180 in the inserting operation. Each engaging member 910 includes an elongated member 911 that extends in the front-rear direction along the upper surface of the convey belt 43C and the pivot-engaging member 912 extending from a front end of the elongated member 911 diagonally frontward and downward.

As shown in FIG. 16(*a*), the pivot-engaging member 912 is pivotably supported at the front end of the elongated member 911. Note that the pivot-engaging member 912 may alternatively supported on the side wall 21 of the main casing 2. Although not shown in the drawings, there is provided a regulation member that prevents the pivot-engaging member 912 from pivoting in a clockwise direction in FIG. 16(*a*) (diagonally rearward and downward) from an original position indicated by a solid line in FIG. 16(*a*). Thus, the pivot-engaging member 912 can only pivot in a counterclockwise direction in FIG. 16(*a*) (diagonally frontward and upward toward an upper position indicated by a dotted chain line) from the original position indicated by the solid line. A torsion spring 913 is disposed between the pivot-engaging member 912 and the elongated member 911 for urging (pulling) the pivot-engaging member 912 downward to make the pivot-engaging member 912 contact the regulation member.

Note that the abutting part 183B is positioned such that the abutting part 183B is located higher than the elongated member 911 (more specifically, located on an upper surface of the elongated member 911) when the cleaning member 180 is at the contact position and such that the abutting part 183B is located lower than the elongated member 911 and overlapping with the pivot-engaging member 912 in the front-rear direction when the cleaning member 180 is at the separate position.

With this configuration, as shown in FIGS. 13 to 15, the abutting parts 183B of the cleaning member 180 contact front sections of the pivot-engaging members 912 when the photosensitive-member unit 142 is moved rearward from the pulled-out position into the main casing 2. At this time, the pivot-engaging members 912 cannot pivot rearward, so the abutting parts 183B pivot upward and frontward to bring the cleaning member 180 to the contact position.

With this configuration, the cleaning member 180 that has been maintained at the separate position when the photosensitive-member unit 142 is at the pulled-out position can reliably be pivoted to the contact position when the photosensitive-member unit 142 is inserted into the main casing 2.

Figure 17:
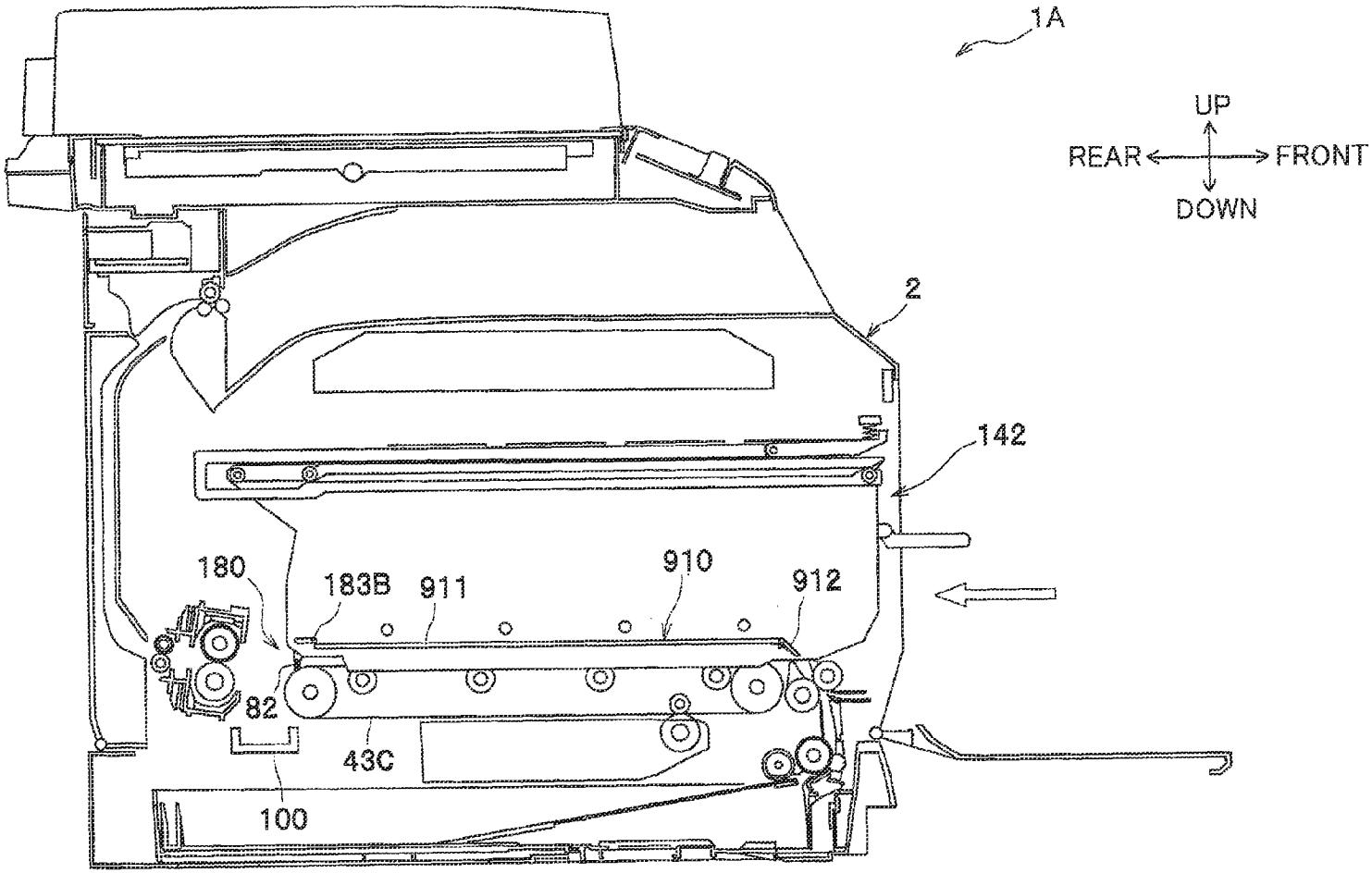
FIG. 17 is a cross-sectional side view of the color laser printer according to the second embodiment in a state immediately before the cleaning member disengages from the engaging member.
Figure 18:
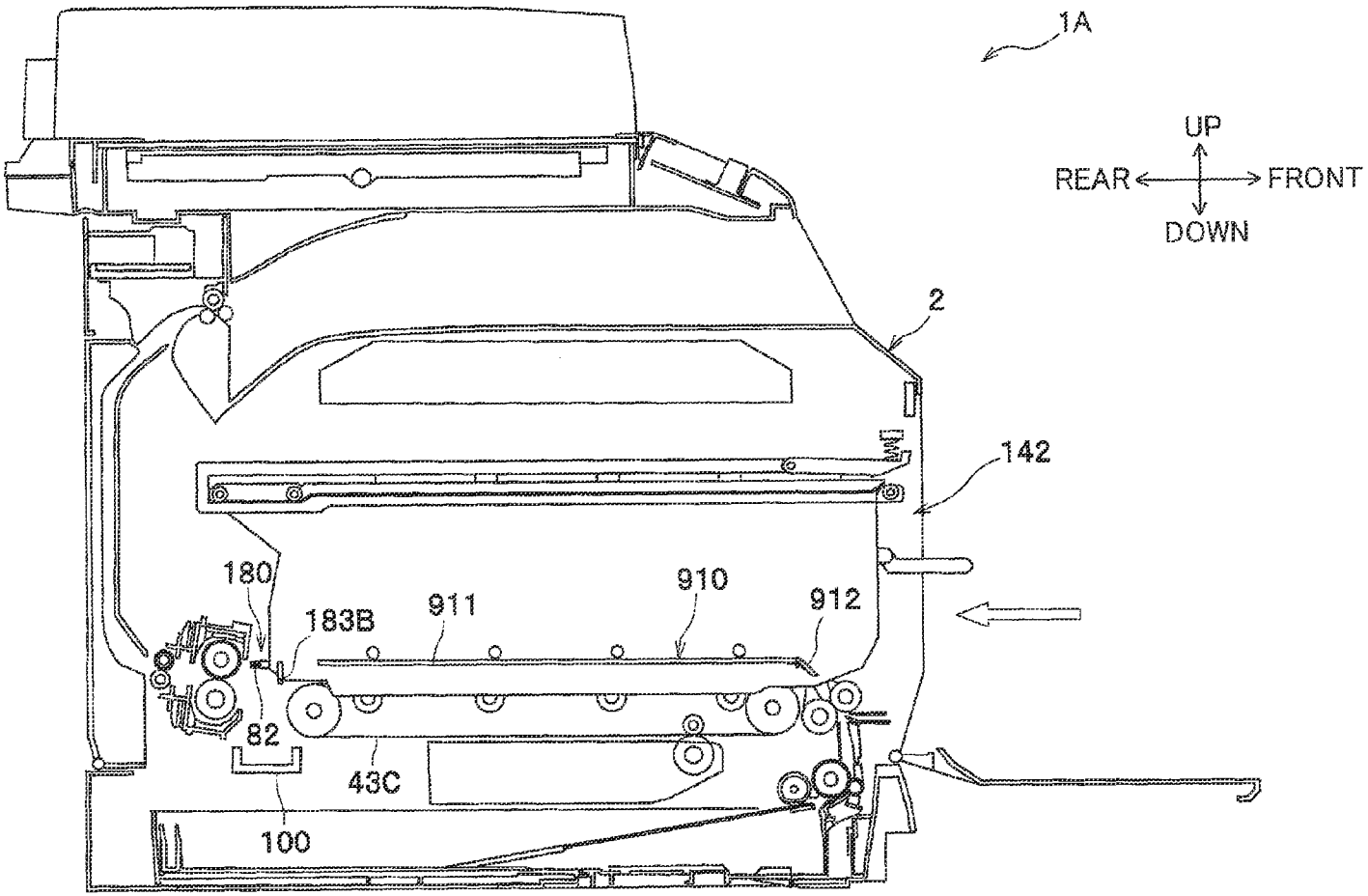
FIG. 18 is a cross-sectional side view of the color laser printer according to the second embodiment with the cleaning member disengaged from the engaging member and pivoted to the separate position.

The cleaning member 180 brought to the contact position in this manner is maintained at the contact position by the abutting parts 183B being supported on the elongated members 911 until the cleaning member 180 is past the convey belt 43C. Thus, the cleaning member 180 can reliably clean the convey belt 43C. As sequentially shown in FIGS. 17 and 18, the abutting parts 183B come off the rear edges of the elongated members 911 when the photosensitive-member unit 142 reaches a position near the mounting position in the main casing 2, and the urging force of the coil spring 85 returns the cleaning member 180 from the contact position to the separate position.

That is, the coil spring 85 and the regulation pins 174 together function as a retracting mechanism.

With this configuration, the coil spring 85 urges the cleaning member 180 toward the separate position with a relatively strong urging force. Thus, the cleaning member 180 can reliably sweep extraneous matters on the convey belt 43C toward the collect member 100 located rearward with a relatively great force when pivoting to the separate position.

When the photosensitive-member unit 142 is pulled out frontward from the mounting position in the pulled-out position, the abutting parts 183B pass beneath the elongated members 911 without engaging with the same. Thus, the cleaning member 180 is moved frontward while maintained at the separate position by the urging force of the coil spring 85. That is, in this embodiment, the coil spring 85 and the regulation pins 174 together function as a separate-position maintaining mechanism.

Figure 19:
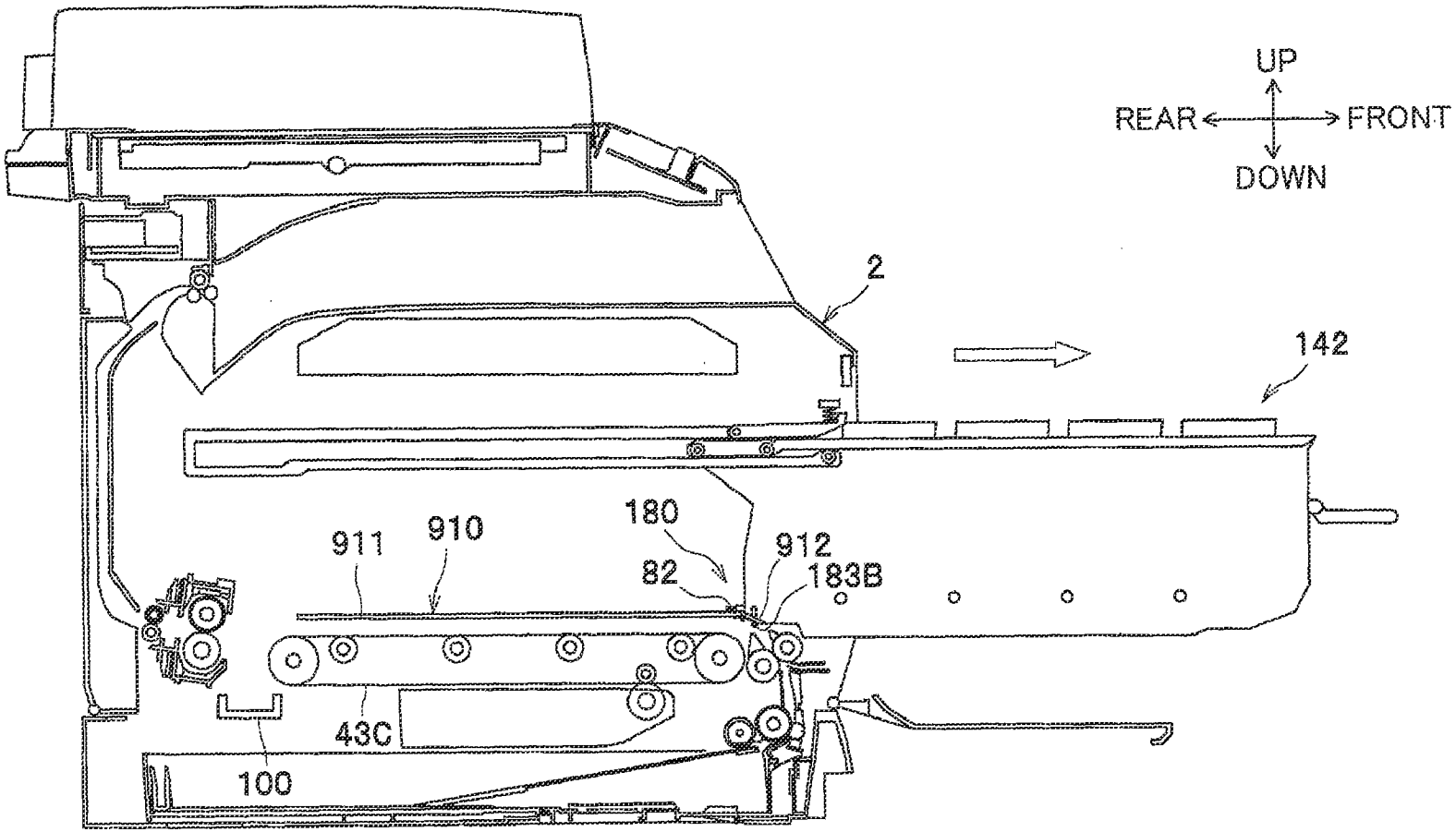
FIG. 19 is a cross-sectional side view of the color laser printer according to the second embodiment with the cleaning member abutting the engaging member when the photosensitive-member unit is pulled out of the main casing.

Subsequently, the abutting parts 183B abut the rear side of the pivot-engaging members 912 as shown in FIG. 19. As a result, the abutting parts 183B press and pivot the pivot-engaging members 912 frontward against the urging force of the torsion springs 913 to the upper position indicated by the dotted chain line in FIG. 16(*a*). Then, the photosensitive-member unit 142 is detached from the main casing 2 with the cleaning member 180 maintained at the separate position. Thus, the cleaning member 180 can be prevented from causing dirtying of the desk or the like when the detached photosensitive-member unit 142 is placed on the desk.

In the above-described first and second embodiments, the drawer 70 is configured to be completely detached from the main casing 2. However, the drawer 70 may be configured to be pulled out from the opening 2A, but not to be detached from the main casing 2 without using tools. In this case also, as long as the cleaning member 80 is configured to pivot back to the contact position from the separate position when the drawer 70 is pulled out all the way to the pulled-out position as shown in FIG. 12, for example, then the cleaning member 80 can reliably cleans the convey belt 43C when the drawer 70 is returned toward the rear thereafter. Also, in the case of the second embodiment, as long as the pivot shaft 183 is past the pivot-engaging member 912 on the front when the drawer 70 is pulled out to the pulled-out position as shown in FIG. 13 so as to let the pivot-engaging members 912 return to the original position, the cleaning member 180 can be brought to the contact position by the engagement between with the pivot-engaging members 912 and the abutting parts 183B and clean the convey belt 43C when the drawer 70 is returned rearward thereafter.

In the above-described embodiments, the drum cartridges 61 are detachably mounted on the drawer 70. However, this is not limitation of the invention. The drum cartridges 61 may be fixed to the drawer 70.

In the above-described embodiments, the convey belt 43C is used as a belt for conveying the paper sheet P. However, this is not limitation of the invention. An intermediate transfer belt onto which toner images are transferred from the photosensitive drums 61A may be used, for example.

In the above-described embodiments, the blush-shaped sliding contact member 82 is used as a cleaning member. However, this is not limitation of the invention. For example, a flexible film or a sponge may be used instead.

In the above-described embodiments, the cleaning member (sliding contact member 82) is formed movable relative to the photosensitive-member unit 42, 142. However, the cleaning member can be fixed to the photosensitive-member unit 42, 142. In this case also, the cleaning member can separate from the convey belt 43C along an extended line of the surface of the convey belt 43C if the cleaning member is fixed to a rear edge of the photosensitive-member unit 42, 142 (at a position upstream of a most-upstream one of the photosensitive drums 61A with respect to the pull-out direction).

In the above-described embodiments, the cleaning member is formed pivotable relative to the photosensitive-member unit 42, 142. However, the cleaning member may be formed movable in the up-down direction with respect to the photosensitive-member unit 42, 142 (at least in a direction perpendicular to the surface of the convey belt 43C), for example. The cleaning member may be configured to be movable in the up-down direction by engaging a sloped surface of a wedge-shaped cam member provided to the main casing 2 with a sloped surface formed on the cleaning member, for example.

In the above-described second embodiment, the coil spring 85 is used. However, a leaf spring or a wire spring may be used instead.

In the above-described embodiments, the collect member 100 is provided to the main casing 2. However, the collect member 100 may be provided to the photosensitive-member unit 42, 142, instead.

In the above-described embodiments, the cleaning member 80, 180 is configured to pivot from the contact position to the separate position before the photosensitive-member unit 42, 142 reaches the mounting position in the inserting operation. However, the cleaning member may be configured to be maintained at the contact position when the photosensitive-member unit 42, 142 is at the mounting position and to retract from the contact position to the separate position when the photosensitive-member unit 42, 142 is pulled frontward from the mounting position.

In the above-described embodiments, the invention is applied to the color laser printer 1, 1A. However, the invention is also applicable to different image forming devices, such as a copier device or a multifunction device.

In the above-describe embodiments, the photosensitive drum 61A is used as a photosensitive member. However, a belt-shaped photosensitive member, for example, may be used.

What is claimed is:

1. An image forming device comprising:

a main casing formed with an opening;

a photosensitive-member unit disposed at a mounting position within the main casing and including a plurality of photosensitive members aligned in a line along a first direction, the photosensitive-member unit being movable in the first direction with respect to the main casing; and a belt disposed in confrontation with the plurality of photosensitive members, wherein:

the photosensitive-member unit is pulled out of the main casing through the opening when pulled in a pull-out direction parallel to the first direction;

the photosensitive-member unit is provided with a cleaning member that is disposed on an upstream side of a most-upstream one of the photosensitive members with respect to the pull-out direction;

the cleaning member slidingly contacts the belt when the photosensitive-member unit is moved with respect to the main casing; and the cleaning member is located at a predetermined position separate from the belt when the photosensitive-member unit is at the mounting position.

2. The image forming device according to claim 1, further comprising a retracting mechanism, wherein;

the cleaning member is movable with respect to the photosensitive-member unit between a contact position where the cleaning member can contact the belt and a separate position where the cleaning member is separate from the belt at least in a direction perpendicular to a surface of the belt; and the retracting mechanism retracts, at a position near the predetermined position, the cleaning member from the contact position to the separate position.

3. The image forming device according to claim 2, wherein the retracting mechanism is formed on the cleaning member and the main casing.

4. The image forming device according to claim 2, further comprising a separate-position maintaining mechanism that maintains the cleaning member at the separate position when the photosensitive-member unit is pulled in the pull-out direction.

5. The image forming device according to claim 4, further comprising a returning mechanism that returns, at a position near the opening, the cleaning member from the separate position to the contact position, the returning mechanism being formed on the cleaning member and the main casing.

6. The image forming device according to claim 1, wherein the cleaning member has a width wider than a print width of the photosensitive members with respect to a second direction perpendicular to the first direction.

7. The image forming device according to claim 1, wherein:

the cleaning member is pivotable with respect to the photosensitive-member unit; and the cleaning member sweeps extraneous matters on the belt toward the upstream side in the pull-out direction by pivoting from a contact position to a separate position on the upstream side of the contact position in the pullout direction when the photosensitive-member unit is inserted to the mounting position within the main casing in an inserting direction opposite to the pull-out direction.

8. The image forming device according to claim 1, wherein:

the photosensitive-member unit at the mounting position is located at a position higher than the belt;

the cleaning member is movable with respect to the photosensitive-member unit between a contact position where the cleaning member can contact the belt and a separate position where the cleaning member is separate from the belt;

the photosensitive-member unit includes an urging member that urges the cleaning member toward the separate position so as to maintain the cleaning member at the separate position when the photosensitive-member unit is detached from the main casing; and the main casing is provided with an engaging member that engages with the cleaning member to move the cleaning member to the contact position against urging force of the urging member when the photosensitive-member unit is inserted into the main casing.

9. The image forming device according to claim 1, further comprising a collect member disposed below the cleaning member when the photosensitive-member unit is at the mounting position, the collect member receiving extraneous matters fallen off the cleaning member.

* * * * *